US006885156B2

(12) United States Patent
Tajima et al.

(10) Patent No.: US 6,885,156 B2
(45) Date of Patent: Apr. 26, 2005

(54) ELECTRON-EMITTING DEVICE AND IMAGE FORMING APPARATUS

(75) Inventors: Hisao Tajima, Kanagawa (JP); Toshimitsu Kawase, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 85 days.

(21) Appl. No.: 09/909,016

(22) Filed: Jul. 20, 2001

(65) Prior Publication Data

US 2002/0021081 A1 Feb. 21, 2002

(30) Foreign Application Priority Data

Jul. 24, 2000 (JP) ..... 2000-222936
Jul. 12, 2001 (JP) ..... 2001-212033
Jul. 18, 2001 (JP) ..... 2001-218314

(51) Int. Cl.[7] ..... G09G 3/10

(52) U.S. Cl. ..... 315/169.3; 313/495

(58) Field of Search ..... 315/169.1–169.4, 315/167, 309, 310, 491, 495, 496, 497, 165; 313/505, 310, 491, 495, 497, 309, 396, 292, 496; 345/74.1, 75.1, 75.2

(56) References Cited

U.S. PATENT DOCUMENTS 4,893,056 A * 1/1990 Hara et al. ..... 3123/495
5,866,988 A * 2/1999 Oda ..... 315/169.3
6,114,804 A 9/2000 Kawase et al. ..... 313/495
6,169,356 B1 1/2001 Ohnishi et al. ..... 313/495
6,278,233 B1 * 8/2001 Sanou et al. ..... 313/495
6,342,875 B2 * 1/2002 Todokoro ..... 345/74.1
6,472,803 B1 * 10/2002 Yoshizawa et al. ..... 313/495
6,476,547 B1 11/2002 Kawase ..... 313/495

FOREIGN PATENT DOCUMENTS

EP 0 865 069 A2 9/1998
EP 0 866 490 A2 9/1998
EP 0 865 069 A3 1/1999
EP 0 866 490 A3 1/1999
JP 2-247936 10/1990 ..... H01J/1/30
JP 2-247937 10/1990 ..... H01J/1/30
JP 4-163833 6/1992
JP 5-273592 10/1993
JP 7-235255 9/1995
JP 9-160505 6/1997
JP 10-326581 12/1998
JP 2000-260359 9/2000

* cited by examiner

*Primary Examiner*—Wilson Lee
(74) *Attorney, Agent, or Firm*—Fitzpatrick,Cella, Harper & Scinto

(57) ABSTRACT

Abnormal discharge of an electron-emitting apparatus is suppressed and a thin electric earth connection structure is realized at a low cost. An image-forming apparatus has: a rear plate formed with electron-emitting devices; a face plate facing the rear plate, the face plate being formed with a phosphor which displays an image by emitting light upon incidence of an electron beam emitted from the electron-emitting device and an electrode applied with a voltage to accelerate the electron beam; a frame sandwiched and coupled between the rear and face plates and constituting a vacuum container together with the rear and face plates; a high voltage introducing member for introducing a high voltage from a voltage source; and an independent wire which is electrically independent from the high voltage introducing member and formed surrounding a high voltage area in the vacuum container, wherein a resistor film is formed between the high voltage introducing member and the independent wire. The wire is formed inside and outside of the vacuum container and is connected to an earth potential.

135 Claims, 12 Drawing Sheets

ELECTRON-EMITTING DEVICE AND IMAGE FORMING APPARATUS

BACKGROUND OF THE INVENTION

1. Field of the Invention

The present invention relates to an electron-emitting apparatus using electron-emitting devices. More particularly, the present invention relates to the structure of an acceleration electrode for accelerating emitted electrons.

2. Related Background Art

Display panels as thin type image display apparatus have been used conventionally for the applications to televisions, computer terminals, advertisement media, sign boards and the like. Such thin type image display apparatus include an image display apparatus using electron-emitting devices, an image display apparatus utilizing plasma discharge, an image display apparatus using liquid crystal, an image display apparatus using a vacuum fluorescent display tube and the like.

A wall mount television having a screen size of 40 inches or larger has recently drawn attention, which positively utilizes the features of a thin type image display panel. Among such image display panels, a display apparatus using electron-emitting devices has drawn attention because of its commercial excellence in good image quality and low power consumption.

The operation principle of a display apparatus using electron-emitting devices is similar to a conventional cathode ray tube (CRT), i.e., electrons are emitted in a vacuum container and electrons are collided with phosphor applied with a high voltage to cause a luminescence phenomenon.

This high voltage is about 15 kV to 25 kV for CRT, and about 10 kV to 15 kV for a display apparatus using electron-emitting devices. For this reason, techniques have been proposed which use an electrical earth connection structure and an electrical insulating structure near the phosphor applied with a high voltage.

A conventional electrical earth connection structure for CRT will be described with reference to FIG. 17. FIG. 17 is a transverse sectional view of a general CRT as a conventional image display apparatus.

Referring to FIG. 17, reference numeral 1700 represents a face plate whose inner side is provided with phosphor for displaying an image and a conductive film. Reference numeral 1701 represents a funnel constituting a vacuum container of CRT, and reference numeral 1702 represents a metal tension band for explosion proof. Reference numeral 1703 represents a mount lug formed on the outer periphery of the tension band 1702. CRT is mounted in the housing of the image display apparatus such as a television by using the mount lug 1703.

Reference numeral 1704 represents a low resistance film containing carbon or the like and formed on the outer wall of the funnel. The low resistance film is coated on the whole outer wall of the funnel excepting an area near a high voltage applying unit 1707 to be described later. Reference numeral 1705 represents a ground (GND) cable for connecting the metal tension band (explosion proof band) 1702 and low resistance film 1704 to the earth potential of the housing. Reference numeral 1706 represents an earth. Specifically, the end of the GND cable is connected via a terminal to an earth potential pattern of an electric circuit in the CRT housing (not shown).

Reference numeral 1707 represents a high voltage applying unit for applying a high voltage to the conductive film of the face plate. The high voltage applying unit has an electrical connection structure in an insulating cap. Reference numeral 1708 represents a high voltage cable whose one end is connected to the high voltage applying unit and whose other end is connected to a high voltage source (not shown).

Reference numeral 1709 represents an electron gun unit having a function of generating thermoelectrons in accordance with a video signal and accelerating them.

As above, a large earth potential area is formed on the funnel between the electron gun unit and face plate of CRT and on the tension band near the face plate. This earth potential area is used as a GND cable and connected to the earth potential of an electric circuit.

A high voltage is applied to the conductive film to form an image on the face plate, via the area of the funnel from which a partial area of the earth potential area is removed.

In an electrical earth connection structure of a conventional CRT, the earth connection is realized by using the electrically stable GND cable which is connected to the funnel excepting the high voltage applying unit and the area near the face plate.

There are other related arts described in the following.

JP-A-4-163833 discloses a flat panel electron beam image forming apparatus having a linear hot-cathode and a complicated electrode structure mounted in a vacuum panel. As the method of forming such a vacuum panel, a method of hermetically bonding a rear plate and a face plate with adhesive by using a frame or not by using a frame if the space between the rear and face plates is narrow. The rear plate is made of glass and formed with an electron source with a plurality of electron-emitting devices disposed in a matrix and a plurality of driving connection lines disposed in a matrix, and the face plate is made of glass and formed with an image-forming member. As the adhesive, glass material having a low melting point is used. A process of raising temperature to about 400° C. high is used for softening the glass material. During this process, various components are exposed in a high temperature environment, including the face and rear plates, an atmospheric pressure supporting spacer necessary for the vacuum panel, an anode terminal to be described later and the like. After the panel is structured, the inside of the panel is evacuated by an evacuation process to form a vacuum panel. After a process of electrically connecting an external drive circuit connection leads formed on the rear panel side, the vacuum panel is assembled in the housing to complete an image-forming apparatus.

In the image-forming apparatus using electron beams constructed as above, while an electron acceleration voltage of about several hundreds V to several tens KV is applied between two glass plates (rear plate formed with an electron source and a face plate formed with an image-forming member), an image signal is applied from an external signal processing circuit to rear plate connection leads to emit electrons at a desired position. The emitted electrons accelerated by a potential difference between two glass plates make the image-forming member on the face plate emit light to form an image. This acceleration voltage is preferably set as high as possible, at least about several kV in order to obtain luminescence of good color when a normal phosphor is used as the image-forming member. In order to apply a voltage of about several kV to the image-forming member, the connection structure of a voltage supply terminal is desired to take discharge and high voltage into consideration.

Such an image-forming apparatus has a structure equipped with an anode connection unit for supplying a high voltage to the image-forming member. For example, in the anode terminal structure described in JP-A-10-326581, a high voltage supplied from a high voltage source of the image-forming apparatus is supplied via a high voltage cable to the anode connection unit of the rear plate, and via a lead wire and via a lead wire of the image-forming member on the face plate, to the image-forming member.

Another related art is JP-A-2000-260359 which discloses the structure of applying a high voltage through an electron source substrate formed with electron-emitting devices.

Another related art is JP-A-5-273592 which discloses the structure in which an earth terminal of a control substrate of a liquid crystal panel is made in contact with a clip which is in turn made in contact with a frame member to be connected to the ground.

JP-A-9-160505 discloses the structure of a CRT earth member.

SUMMARY OF THE INVENTION

The present application provides an invention of an electron-emitting apparatus having electron-emitting devices and an acceleration electrode and an image-forming apparatus. According to the aspects of the invention, the electron-emitting apparatus and image-forming apparatus provide the structure which can suppress abnormal discharge and the structure which can apply a predetermined potential such as a ground potential to a predetermined wire simply and/or reliably.

According to one aspect of the present invention, there is provided an electron-emitting apparatus comprising:

electron-emitting devices;

driving wires connected to the electron-emitting devices;

an electron source substrate formed with the electron-emitting devices and the driving wires;

an acceleration electrode mounted at a position facing the electron source substrate, the acceleration electrode being applied with an acceleration potential for accelerating electrons emitted from the electron-emitting devices;

a potential supply path for supplying the acceleration potential to the acceleration electrode, the potential supply path being introduced via an intermediate area on the side of the electron source substrate;

a first wire formed around the intermediate area; and a resistor film formed between the first wire and the intermediate area, the resistor film electrically connecting the potential supply path and the first wire.

The advantage of this structure is an ability to suppress abnormal discharge.

It is particularly effective that the first wire is formed separately from the driving wires.

It is particularly effective that the first wire surrounds completely a periphery of the intermediate area.

According to another aspect of the present invention, there is provided an electron-emitting apparatus comprising:

electron-emitting devices;

driving wires connected to the electron-emitting devices;

an electron source substrate formed with the electron-emitting devices and the driving wires;

an acceleration electrode mounted at a position facing the electron source substrate, the acceleration electrode being applied with an acceleration potential for accelerating electrons emitted from the electron-emitting devices;

a potential supply path for supplying the acceleration potential to the acceleration electrode, the potential supply path being introduced via an intermediate area on the side of the electron source substrate;

a first wire provided separately from the driving wires and formed in a creepage surface between the intermediate area and the driving wires; and a resistor film formed in a creepage surface between the first wire and the intermediate area, the resistor film electrically connecting the potential supply path and the first wire.

It is preferable to adopt the structure that the first wire surrounds the intermediate area without any gap in the creepage surface between the first wire and intermediate area.

It is preferable to adopt the structure that the potential supply path passes through the electron source substrate. In this case, the intermediate area on the electron source substrate side corresponds to the area through which the potential supply path extends from the inside to outside of the electron source substrate.

If the potential supply path directly passes through the substrate, this passing area corresponds to the intermediate area. It is preferable to adopt the structure that an integrated structure of the potential supply path and an insulating member is inserted into a hole formed through the electron source substrate. For example, if it is difficult to handle or seal only the potential supply path, the potential supply path is integrated with an insulating member larger than the potential supply path, so that it becomes easy to handle and seal it. If the integrated structure having the potential supply path passing through the insulating member is used, the area where the potential supply path passes through the insulating member corresponds to the intermediate area on the electron substrate side.

The potential supply path may take various shapes. For example, a straight path may be preferably adopted. If the structure that a straight conductor is used for potential supply, the potential is supplied along the straight conductor. Another structure may also be adopted in which a coil spring or a cantilever spring is used as at least a portion of the potential supply path and the acceleration electrode and a lead portion of the acceleration electrode is pushed by using spring elasticity.

It is preferable to adopt the structure that the first wire is applied with a predetermined potential.

It is preferable to adopt the structure that the first wiring is formed separately from the driving wires, and a potential difference between the predetermined potential and the acceleration potential is larger than a potential difference between the predetermined potential and a potential applied to the driving wires. The potential applied to the driving wires is the lowest potential applied to the driving wires for driving the electron-emitting devices.

As will be later described, the electron source substrate is preferably such a substrate in which electron-emitting devices are disposed in a matrix shape, a plurality of scan wires and modulation wires are used as the driving wires, and the electron-emitting devices are connected in a matrix shape by the scan and modulation wires. In matrix-driving such an electron source, scan signals and modulation signals are applied to the scan wires and modulation wires as drive signals to change potentials. In the structure that the potential applied to the driving wire changes with the drive signal, a difference between a potential applied to the driving wire and having a largest potential difference from the acceleration potential and a potential applied to the first wire is made smaller than the potential difference between the acceleration potential and the potential applied to the first wire. The potential applied to the first wire is set near to the potential applied to the driving wire. It is particularly preferable that the ground potential (potential obtained through earth connection) is applied to the first wire.

It is preferable that the first wire is a ring shape wire.

It is preferable that the first wire is formed so that each portion of the first wire is at an equal distance from each portion of the intermediate area most nearest to each portion of the first wire. This structure in particular can suppress abnormal discharge efficiently.

It is preferable to set the resistance value of the resistor film so that current flowing through the intermediate area and first wire does not become too large. It is also preferable to set the resistance value so that abnormal discharge can be suppressed sufficiently. Specifically, it is preferable that the resistor film has a sheet resistance of $1\times10^{9}$ Ω/□ or higher. It is also preferable that the resistor film has a sheet resistance of $1\times10^{16}$ Ω/□ or lower.

It is preferable that the resistor film is a nitride film of alloy of germanium and transition metal. It is preferable that the transition metal is at least one metal selected from a group consisting of chromium, titanium, tantalum, molybdenum and tungsten.

It is preferable that the resistor film has a relative resistance of $10^{-5}\times Va^{2}$ Ωcm or higher where Va is a potential difference between a potential applied to the first wire and the acceleration potential. It is preferable that the resistor film has a relative resistance of $10^{7}$ Ωcm or lower. It is preferable that the resistor film has a thickness of 10 nm or thicker. It is preferable that the resistor film has a thickness of 1 μm or thinner.

It is preferable that the resistor film has a resistance temperature coefficient of −1%/°C. or higher. It is preferable that the resistor film has a negative resistance temperature coefficient.

According to another aspect of the present invention, there is provided an electron-emitting apparatus comprising:

electron-emitting devices;

driving wires connected to the electron-emitting devices;

an electron source substrate formed with the electron-emitting devices and the driving wires;

an acceleration electrode mounted at a position facing the electron source substrate, the acceleration electrode being applied with an acceleration potential for accelerating electrons emitted from the electron-emitting devices;

a potential supply path for supplying the acceleration potential to the acceleration electrode, the potential supply path being introduced via an intermediate area on the side of the electron source substrate;

a first wire provided separately from the driving wires and formed in a creepage surface between the intermediate area and the driving wires; and a periodical projection/recess structure formed in a creepage surface between the first wire and the intermediate area.

According to an aspect of the present invention, there is provided an electron-emitting apparatus comprising:

electron-emitting devices;

driving wires connected to the electron-emitting devices;

an electron source substrate formed with the electron-emitting devices and the driving wires;

an acceleration electrode mounted at a position facing the electron source substrate, the acceleration electrode being applied with an acceleration potential for accelerating electrons emitted from the electron-emitting devices;

a potential supply path for supplying the acceleration potential to the acceleration electrode, the potential supply path being introduced by passing through the electron source substrate;

a first wire provided separately from the driving wires and formed in a creepage surface between the intermediate area and the driving wires;

a sealing structure integrated with the potential supply path and hermetically mounted in a hole formed through the electron source substrate; and a projection/recess structure formed in a creepage surface between the sealing structure and the first wire.

The projection/recess structure can suppress abnormal discharge efficiently. The projection/recess structure may be used preferably in combination with other modifications such as the first wire structure, e.g., the first wire surrounding the intermediate area without any gap, the potential level to be applied to the first wire, the shape of the first wire, the first wire connected to the earth potential.

It is preferable to adopt the structure that the first wire has a lead portion extending to an outside of a vacuum container containing the electron-emitting devices, the acceleration electrode and the first wire, a conductive contact member is in contact with the lead portion, and a predetermined potential is applied to the first wire via the conductive contact member.

It is preferable that the conductive contact member has an elastic portion and elasticity of the elastic portion pushes the lead portion of the first wire. Since the contact member has an elastic portion (e.g., the contact member is made of elastic metal), the contact member can push the lead portion of the first wire by elasticity and reliable contact can be realized.

It is preferable to adopt the structure that the conductive contact member squeezes the lead portion of the first wire on the electron source substrate as well as the electron source substrate.

The structure may also be adopted in which the conductive contact member includes opposing portions, a distance between the opposing portions is longer than a thickness of the electron source substrate and a distance between opposing portions in contact with the lead portion of the first wire is shorter than he thickness of the electron source substrate, when the conductive contact member does not squeeze the electron source substrate. With this structure, connection can be realized easily and reliably, and a supply of the predetermined potential can be realized easily and reliably.

It is preferable to adopt the structure that the electron-emitting apparatus further comprises a second wire different from the acceleration electrode disposed on an acceleration electrode substrate on which the acceleration electrode is formed, wherein the conductive contact member is electrically connected to both lead portions of the first and second wires. It is preferable to adopt the structure that at least a portion of the conductive contact member is squeezed between the electron source substrate and the acceleration electrode substrate, and the conductive contact member is in contact with both lead portions of the first and second wires on the electron source substrate and on the acceleration electrode substrate.

Not only to adopt the structure that the wire lead portion is pushed (or pushed and squeezed) by elasticity, it is preferable to adopt the structure that the conductive contact member has a portion with conductivity and pressure sensitive adhesion, the portion with the pressure sensitive adhesion being in contact with the lead portion of the first wire. It is particularly preferable to adopt the structure that another member as a path or applying a predetermined potential to the first wire is in contact with another portion with the pressure sensitive adhesion of the conductive contact member. As the conductive contact member having a pressure sensitive adhesive portion, a lamination structure of a metal layer and a conductive pressure sensitive adhesive layer can be preferably adopted. The metal layer may be made of copper. The conductive pressure sensitive adhesive layer may contain carbon.

It is particularly preferable in the contact of the conductive contact member to the wire lead portion that the conductive contact member contacts a lead portion extended on a surface same as the surface on which the first line is formed.

In supplying the first or second wire with a predetermined potential, particularly a ground potential, it is preferable to adopt the structure that the predetermined potential is supplied from a cover of the electron-emitting apparatus. The cover is made conductive by using metal or covering it with a conductive film. It is preferable to adopt the structure that the conductive contact member is electrically connected to the cover by fixing the cover to the conductive contact member (with screws, or pressure), and the predetermined potential such as a ground potential is supplied via the cover to the conductive contact member. The material of the cover is preferably aluminum or magnesium. It is preferable to form the cover by extruding. A conductive cover formed by coating a conductive layer on resin may also be used. The conductive layer preferably contains at least one of copper, nickel and carbon. It is preferable to adopt the structure that the conductive cover is connected to the common earth line of the power source of the electron-emitting apparatus.

The conductive contact member may be connected to an electrical cable to apply a predetermined potential to the conductive contact member via the electrical cable. Electrical connection between the conductive contact member and electrical cable is preferably realized by soldering. In connecting the first wire to the earth potential via the conductive contact member, it is preferable to adopt the structure that the conductive contact member is electrically connected to the earth potential of the power source of the electron-emitting apparatus. It is suitable because the structure of using the earth potential of the power source and the structure of connecting the first wire to the earth potential can be used in common.

It is preferable to adopt the structure that the lead portion of the first wire and the lead portions of the driving wires are connected to a common flexible printed circuit. It is preferable that the lead portion of the first wire and/or the lead portions of the driving wires drive and the flexible printed circuit are connected via conductive adhesive. It is particularly preferable that the lead portions and the flexible printed circuit are connected by using an anisotropic conductive tape.

It is preferable to adopt the structure that an acceleration electrode substrate on which the acceleration electrode is formed constitutes a portion of a vacuum container, and the acceleration electrode has a conductive layer formed outside of the vacuum container. The conductive layer may be formed by attaching a film-like member to a substrate. This conductive layer is transparent if it is used with an image-forming apparatus and an image is viewed from the conductive layer side. It is preferable to use ITO (indium tin oxide) as the material of the conductive layer.

It is preferable to adopt the structure that the first wire is applied with a predetermined potential via the conductive layer formed on the acceleration electrode substrate. Electrical connection between the first wire and conductive layer is realized by using the conductive contact member described already or to be described later. A conductive tape is preferable, and a conductive tape with a pressure sensitive portion is more preferable.

It is preferable to adopt the structure that the conductive layer is electrically connected to a conductive cover covering at least a portion of a vacuum container constituted of the acceleration electrode substrate. It is preferable to adopt the structure that an electrical connection between the conductive layer and the conductive cover is established by a member having elasticity and conductivity. The conductor may be a metal wire. By supporting the conductor by an elastic member (particularly preferably by supporting the periphery of the conductor by the elastic member), reliable electrical connection can be realized.

According to another aspect of the present invention, there is provided an electron-emitting apparatus comprising:

electron-emitting devices;

driving wires connected to the electron-emitting devices;

an electron source substrate formed with the electron-emitting devices and the driving wires;

an acceleration electrode substrate facing the electron source substrate;

an acceleration electrode mounted on the acceleration electrode substrate and being applied with an acceleration potential for accelerating electrons emitted from the electron-emitting devices;

a potential supply path for supplying the acceleration potential to the acceleration electrode, the potential supply path being introduced via an intermediate area on the side of the electron source substrate;

a first wire provided separately from the driving wires and formed in a creepage surface between the intermediate area and the driving wires; and a second wire provided separately from the acceleration electrode around the acceleration electrode on the acceleration electrode substrate, wherein a space surrounded by the electron source substrate, the acceleration electrode substrate and a peripheral frame is maintained as a vacuum atmosphere, a lead portion of the first wire is extended outside of the vacuum atmosphere, a lead portion of the second wire is extended outside of the vacuum atmosphere, and a conductive contact member is in contact with the lead portions of the first and second wires.

It is preferable to adopt the structure that the acceleration potential is higher by 3 kV or more than the lowest potential to be applied to the driving wires to drive the electron-emitting devices.

According to another aspect of the present invention, there is provided an image-forming apparatus comprising an electron-emitting apparatus and a phosphor which emits light upon incidence of electrons accelerated by the acceleration potential.

DETAILED DESCRIPTION OF THE PREFERRED EMBODIMENTS

Embodiments of the invention will be described in detail. The main points considered in the following embodiments are as follows.

A plane type thin image-forming apparatus has a crucial danger of discharge. When discharge occurs, a very large current flows instantaneously. If a part of this current flows through driving connection lines of an electron source, a large voltage is applied to electron-emitting devices of the electron source. If this voltage is larger than the voltage applied during the normal operation, the electron emission characteristics may be degraded, or devices may be broken in some cases. In such a case, a portion of an image cannot be displayed so that the image quality lowers and the image-forming apparatus cannot be used in practice.

Since some of plane type image-forming apparatus are used as a wall mount type, it is necessary to reduce the weight thereof. A narrowed frame area (outside of the image area) contributes not only to a product value but also to light weight. However, since a plane type image-forming apparatus applied with a high voltage has a danger of discharge, the frame area cannot be narrowed too much because some creepage distance is required.

In the following, the detailed description of this embodiment will be given.

Figure 1:
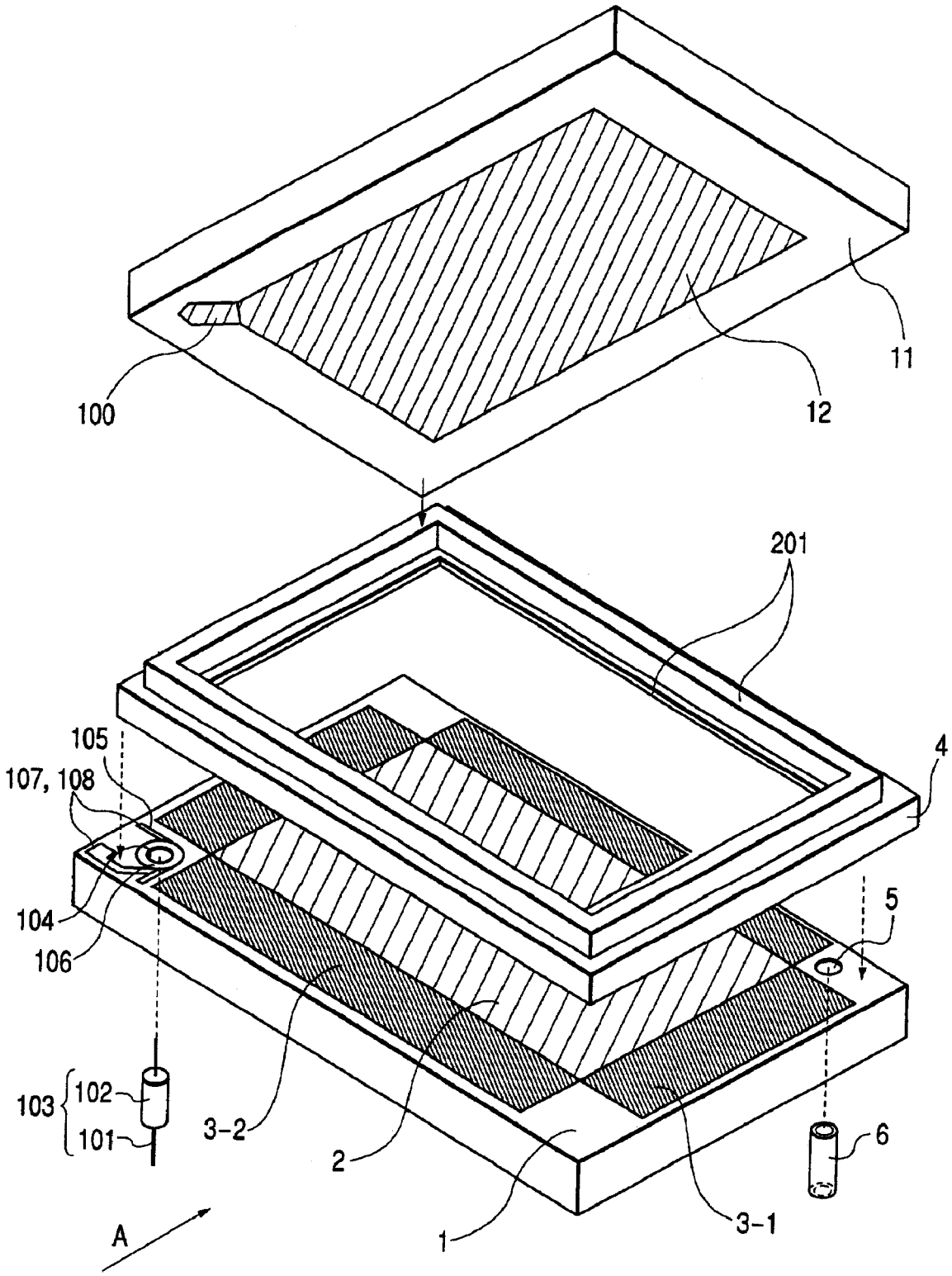
FIG. 1 is a schematic perspective view showing in a disassembled state an example of the structure of an image-forming apparatus according to the invention.
Figure 2:
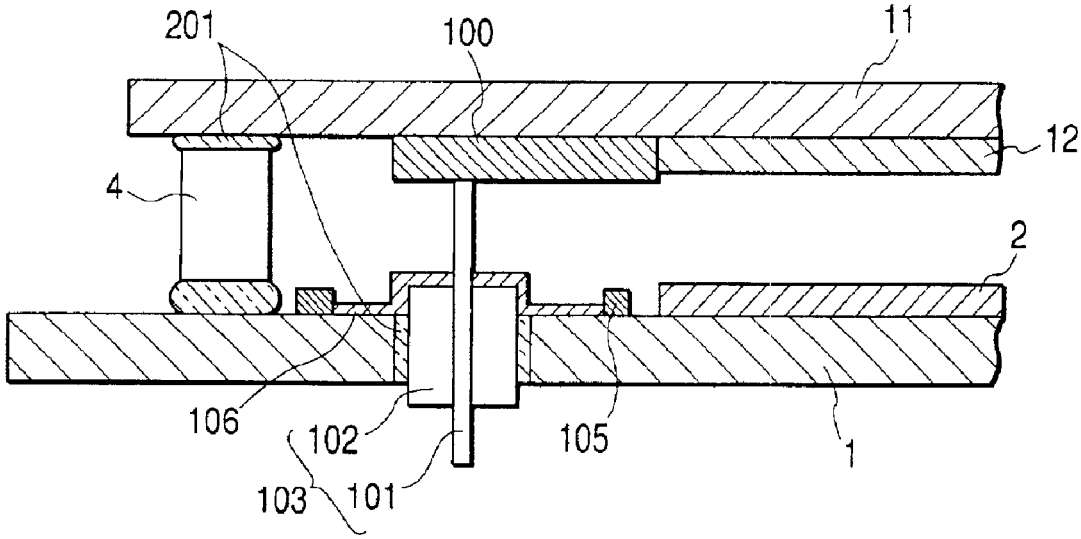
FIG. 2 is a sectional view of an anode terminal unit taken along an arrow A direction shown in FIG. 1.
Figure 3A:
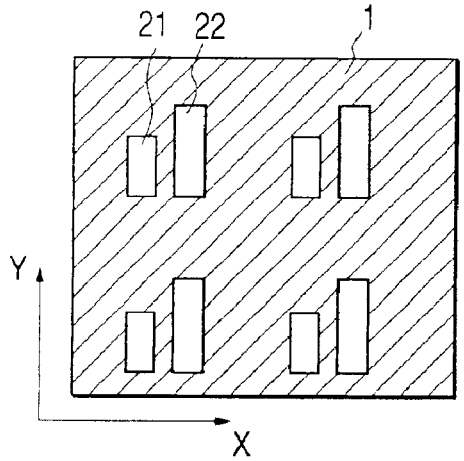
FIGS. 3A, 3B, 3C, 3D and 3E are diagrams illustrating a process of forming a rear plate substrate.
Figure 3B:
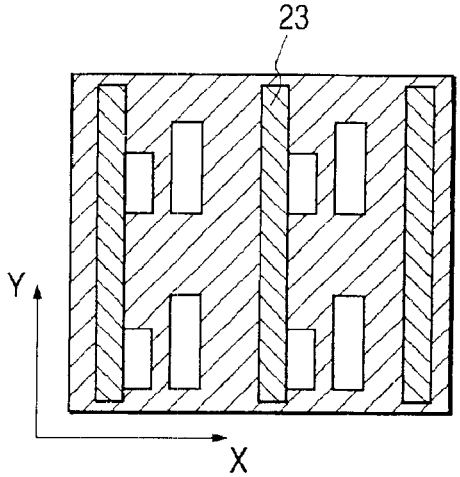
Figure 3C:
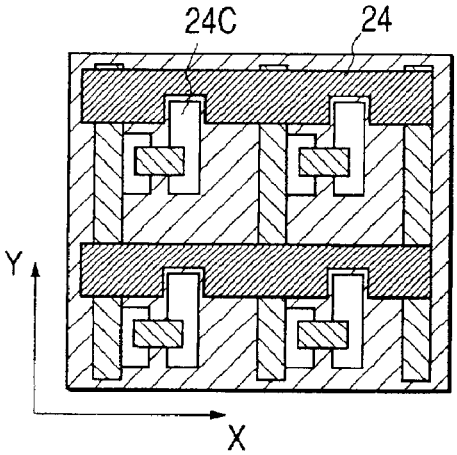

FIG. 1 is a schematic perspective view showing an example of the structure of an image-forming apparatus in a broken state according to the invention. FIG. 2 is a partial sectional view of an anode terminal unit taken along an arrow A direction shown in FIG. 1. FIGS. 3A to 3E are diagrams illustrating a process of forming a rear plate substrate, by taking as an example a portion of an electron source. FIG. 4 is a plan view showing the structure near an anode terminal unit of the rear plate.

Reference numeral 1 represents a rear plate serving as an electron source substrate on which an electron source is formed and as a portion of a vacuum container, and reference numeral 2 represents an electron source area in which a plurality of electron-emitting devices such as surface conduction electron-emitting devices connected to driving connection lines for driving the devices as desired are formed. The driving connection lines have a portion positioned in the electron source area and connection lead portions 3-1 and 3-2. The driving connection lines extend to the outside of the image-forming apparatus via the connection lead portions 3-1 and 3-2 and are connected to a drive circuit of the electron source. Reference numeral 11 represents a face plate formed with an image-forming member. Reference numeral 12 represents the image-forming member including phosphor for emitting light upon emission of electrons from the electron source area 2 and a metal back. Reference numeral 100 represents a connection lead for supplying an acceleration potential to the image forming member 12, the connection lead being formed by baking Ag (silver) paste or the like. Reference numeral 4 represents an outer frame sandwiched between the rear plate 1 and face plate 11. The electron source driving connection leads 3 are buried, for example, in low melting glass (frit glass 201) attached to the coupling area between the outer frame 4 and rear plate 1, in order to be extended to the outside. The material of the rear plate 1, face plate 11 and outer frame 4 may use various materials depending upon the conditions, such as soda lime glass, soda lime glass coated with an $SiO_2$ film, glass with a small Na content, and quartz glass. Reference numeral 101 represents a lead-in wire which serves as a potential supply wire for receiving a potential applied from an external high voltage source. Reference numeral 102 represents an insulating member having a cylindrical shape. The lead-in wire 101 hermetically sealed in advance by soldering material such as Ag—Cu and Au—Ni is integrally formed with the insulating member 102 in the central area thereof. As the material of the insulating member 102, for example, ceramics such as alumina and glass having a small Na content, are selected which has a thermal expansion coefficient near to that of the material of rear plate 1, is resistant against a high voltage, and also can prevent a crack in the junction area between the insulating member 102 and rear plate 1 to be caused by a thermal expansion difference at a high temperature. The high voltage terminal may have another structure and is not limited only to the structure described above. In order to ensure the connection between the lead-in wire 101 and connection lead 100, a connection member such as Ag paste and mechanical spring may be provided between the lead-in wire 101 and connection lead 100. The lead-in wire 101 and insulating member 102 constitute a hermetically sealed lead-in terminal 103 of an integrated structure. Reference numeral 104 represents a hole formed through the rear plate 1, the hermetically sealed lead-in terminal 103 being inserted into this hole. Adhesive capable of hermetical sealing, such as frit glass 201, is used for the fixation between the hermetically sealed lead-in terminal 103 and the through hole 104 formed in the rear plate 1. The through hole 104 is positioned in any one of the four corners of the rear plate not formed with the driving connection lead portions 3-1 and 3-2 and inside of the outer frame 4. As the discharge suppression structure for suppressing discharge when a high voltage of several kV is applied via the lead-in wire 101, a first independent wire 105 of a ring shape is formed which surrounds the area (intermediate area) where the lead-in wire 101 passes through the insulating member 102 in the area where the driving connection lead portions 3-1 and 3-2 are not formed. Since the first independent wire 105 has a ring shape, even if an electrode edge is formed on the periphery of the ring, the structure capable of suppressing abnormal discharge can be provided. The surrounding shape may be a polygon shape. However, the ring shape is preferable from the viewpoint of electric field concentration. Although it is preferable that the first independent wire 105 surrounds completely the through hole, the first independent wire may have a partial gap or slit. The independent wire 105 is not required to have a surrounding shape, but it may be formed in at least an area where the distance between the intermediate area and driving connection lead portions is shortest. In the case of a narrow frame area, it is preferable to take into consideration work burr of the outer frame 4, a protruded shape of frit adhesive, a shape of driving connection lead portions and the like, and to adopt the surrounding structure, particularly a completely surrounding structure. A potential regulating or defining structure is formed by electrically conducting the independent wire 105 and the lead-in wire 101 of the hermetically sealed lead-in terminal 103 via a high resistance film (dielectric breakdown proof structure 106). Other dielectric breakdown proof structures such as elongating the creepage distance by forming an irregular structure may also be used. This dielectric breakdown proof structure 106 is sufficiently resistant against a desired high voltage so that damages such as device deterioration to be caused by a flow of discharge current into the electron source area can be avoided. In addition, even if a high voltage lead-in area is made smallest, discharge can be suppressed. It is therefore possible to shorten the distance between the image forming member 12 in vacuum to the inner side of the outer frame 4. The material of the high resistance film may be nitride, oxide, carbide or the like.

Reference numeral 5 represents an air exhaust hole for evacuation, and reference numeral 6 represents a glass tube disposed in the air exhaust hole 5. The glass tube is connected to an unrepresented external vacuum system, and sealed after the evacuation process for electron-emitting devices. If the image-forming apparatus is to be assembled in an evacuation system, the glass tube 6 and air exhaust hole 5 are not necessary.

The type of an electron-emitting device constituting the electron source to be used by the invention is not particularly limited so long as it has the electron-emitting characteristics and size suitable for a subject image-forming apparatus. Hot electron emitting devices, field effect electron-emitting devices, semiconductor electron-emitting devices, MIM type electron-emitting devices or cold cathode electron-emitting devices such as surface conduction type electron-emitting devices may also be used. A surface conduction type electron-emitting device to be used in the embodiments to be described later is preferable to be used with this invention. This surface conduction type electron-emitting device is similar to that described in JP-A-7-235255 submitted by the present assignee.

The features of the invention will further be detailed with reference to the embodiments.

(First Embodiment)

Figure 4:
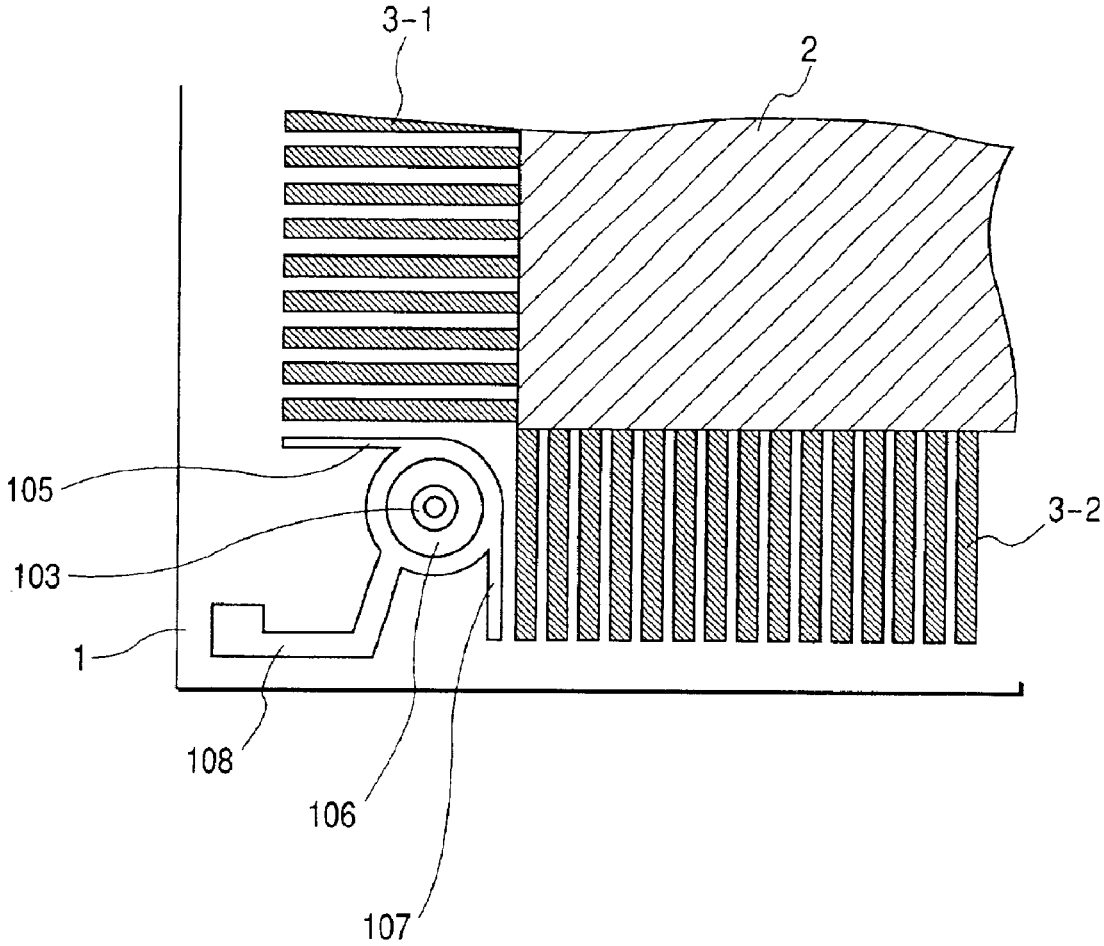
FIG. 4 is a plan view showing the structure near an anode terminal unit of the rear plate.
Figure 5:
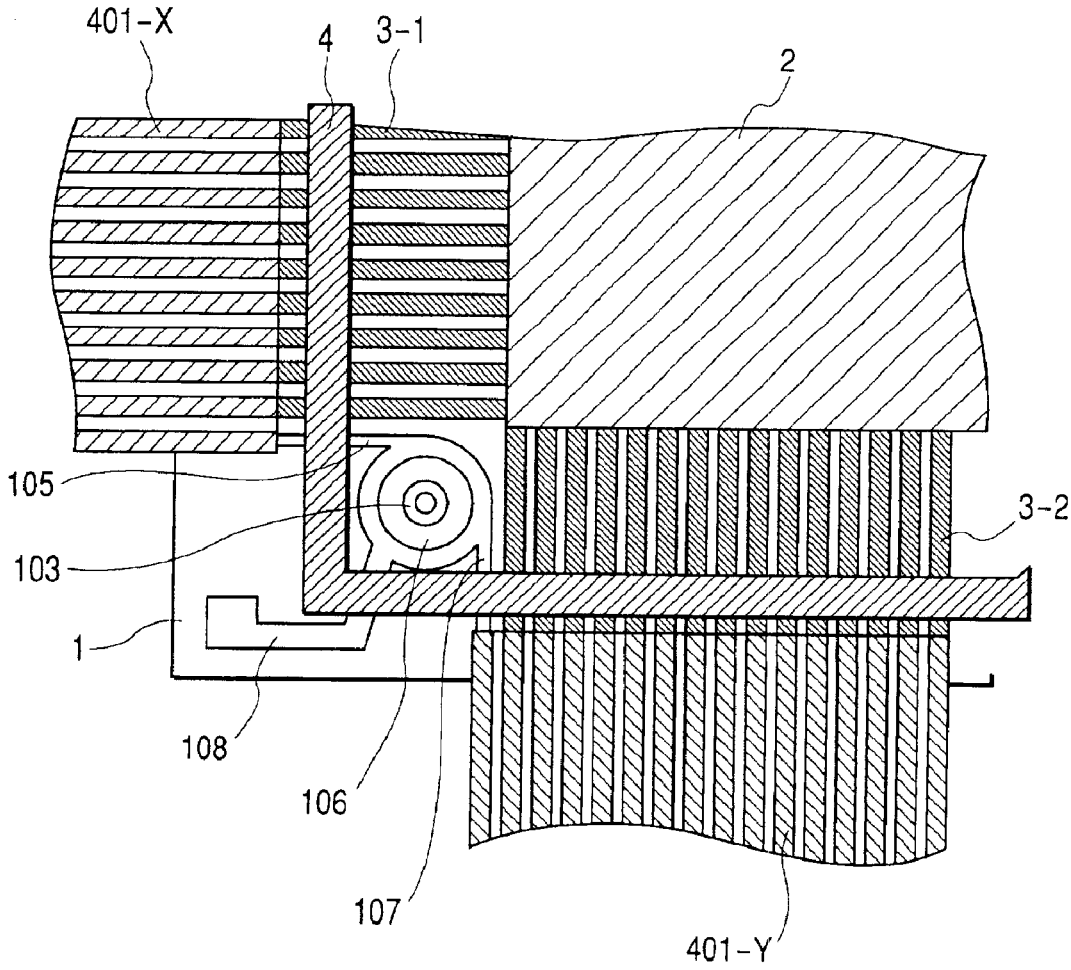
FIG. 5 is a plan view showing the structure near the anode terminal unit with the face plate of the vacuum panel being removed.
Figure 6A:
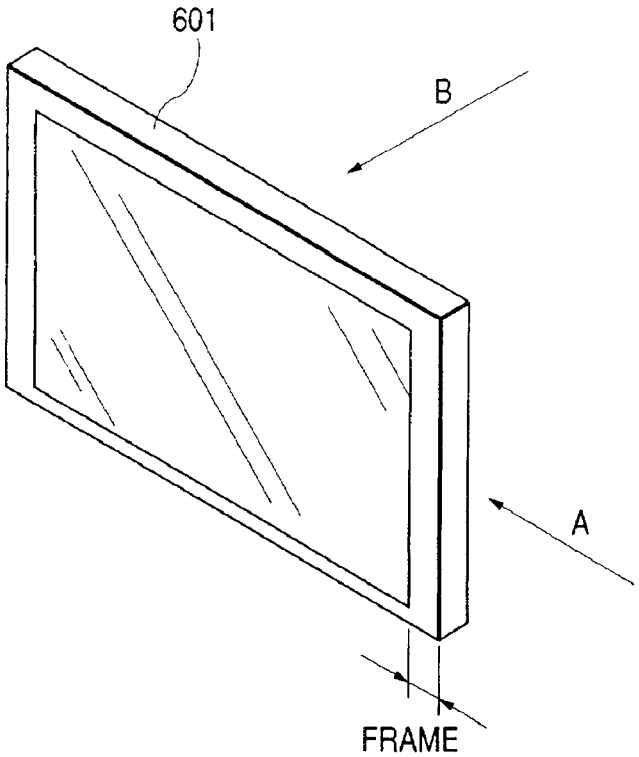
FIG. 6A is a diagram briefly showing the internal structure of a plane type image-forming apparatus.
Figure 6B:
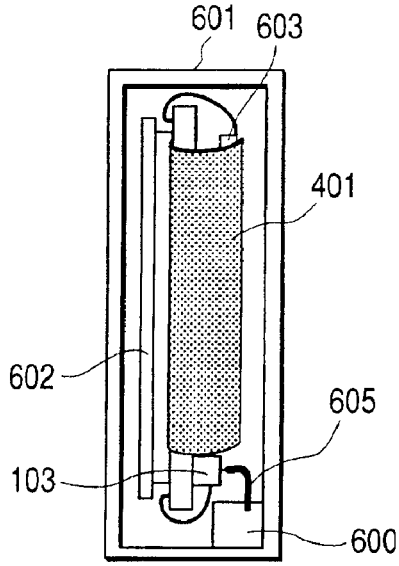
FIG. 6B is a sectional side view taken along an arrow A direction of FIG. 6A.
Figure 6C:
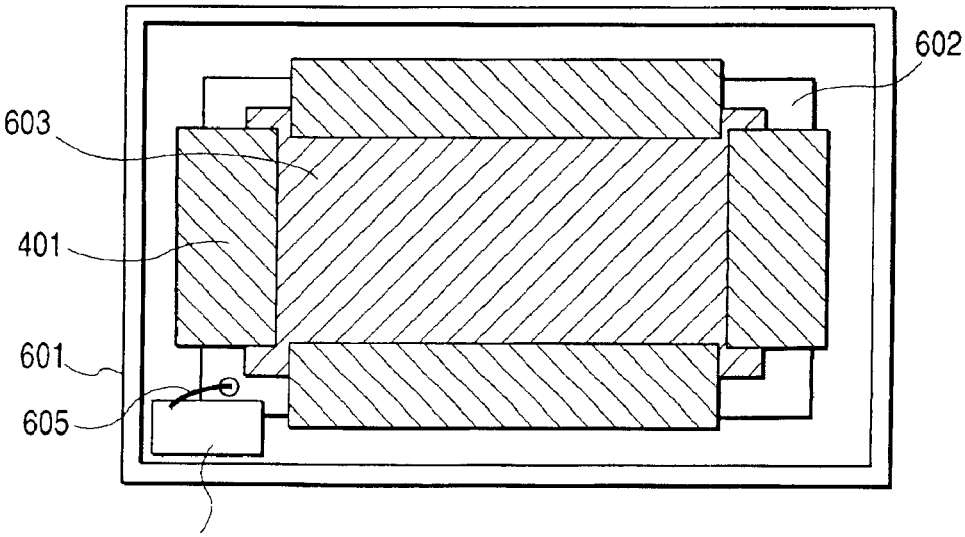
FIG. 6C is a transverse sectional view taken along an arrow B direction of FIG. 6A.

The first embodiment will be described more specifically with reference to the accompanying drawings. FIG. 1 is a schematic perspective view showing an example of the structure of an image-forming apparatus in a broken state according to the invention. FIG. 2 is a partial sectional view of an anode terminal unit taken along an arrow A direction shown in FIG. 1. FIGS. 3A to 3E are diagrams illustrating a process of forming a rear plate substrate, by taking as an example a portion of an electron source. FIG. 4 is a plan view showing the structure near an anode terminal unit of the rear plate. FIG. 5 is a plan view showing the structure near the anode terminal unit with the face plate of the vacuum panel being removed. FIG. 6A is a diagram briefly showing the internal structure of a plane type image-forming apparatus, FIG. 6B is a sectional side view taken along an arrow A direction of FIG. 6A, and FIG. 6C is a transverse sectional view taken along an arrow B direction of FIG. 6A.

In FIG. 1, reference numeral 1 represents the rear plate formed with an electron source and made of soda lime glass, and reference numeral 2 represents the electron source area in which a plurality of surface conduction type electron-emitting devices described in JP-A-7-235255 are disposed in a matrix shape. In the electron source area, electron-emitting devices are connected in a matrix shape by driving connection lines or wires including scanning connection wires and modulating connection wires. The driving connection wires in the electron source area are extended to the outside of the vacuum container along four X and Y directions via the driving connection lead portions. The driving connection lead portions 3 are connected to a electron source drive circuit via flexible wires.

Reference numeral 11 represents an acceleration electrode substrate formed with the image forming member 12 and serving as the face plate constituting the vacuum container. The acceleration electrode substrate is made of soda lime glass. Reference numeral 100 represents the connection lead made of printed Ag material and extended from one corner of the image forming member 12. The connection lead is formed at the position capable of abutting on the lead wire of the high voltage terminal introduced through the through hole formed in the rear plate 1. The connection lead 100 is formed by printing it at the position superposing upon the metal back of the image forming member 12 to establish electrical connection. The image forming member 12 is made of phosphor stripes, black stripes and the metal back as the acceleration electrode. The phosphor stripes and black strips are formed by printing. Thereafter, an Al film as the metal back is formed over the stripes by vapor deposition. Reference numeral 4 represents the outer frame sandwiched between the rear plate 1 and face plate 11 and made of soda lime glass. The driving connection leads 3-1 and 3-2 are buried in adhesive (frit glass LS3081 manufactured by Nippon Electric Glass Co., Ltd) attached to the coupling area between the outer frame 4 and rear plate 1, in order to be extended to the outside. Reference numeral 101 represents a lead-in wire made of 426 alloy material. Reference numeral 102 represents the insulating member having a cylindrical shape. The lead-in wire 101 hermetically sealed in advance by soldering material Ag—Cu is integrally formed with the insulating member 102 in the central area thereof. The insulating member is made of alumina ceramics. Reference numeral 104 represents the through hole via which the lead-wire 101 is inserted through the insulating member 102 which hermetically seals and integrates the lead-wire 101. The position where the through hole 104 is formed will be described later.

Next, the processes of forming the rear plate 1 will further be detailed with reference to FIG. 1, FIGS. 3A to 3E and FIG. 4.

(Process A)

On the surface of a cleaned soda lime glass, an $SiO_2$ of 0.5 μm was formed by sputtering to prepare the rear plate 1. Next, a circular through hole 104 shown in FIGS. 1 and 4 and having a diameter of 2 mm for inserting a high voltage terminal was formed. The position of the center of the through hole was in a corner not formed with the electron source area 2 and driving connection lead portions 3-1 and 3-2 and apart from 6 mm from an independent wire to be described later.

On the rear plate, device electrodes 21 and 22 for surface conduction type electron-emitting devices are formed by sputtering and photolithography. Each electrode has a lamination of a Ti layer of 5 nm thickness and a Ni layer of 100 nm thickness. The space between adjacent elements was set to 2 μm (FIG. 3A).

(Process B)

Next, Y-direction connection lines 23 as modulating connection lines were formed by printing Ag paste in a predetermined shape and baking it. The connection lines extend to the outside of the electron source area and the extended portion becomes the driving connection lead portion 3-2 shown in FIG. 1. The connection line has a width of 100 μm and a thickness of about 10 μm (FIG. 3B). At the same time when the Y-direction connection lines were formed, the independent wire 105, independent wire lead portion A 107 and independent wire lead portion B 108 were also formed as shown in FIG. 2. The independent wire 105 has a width of 0.6 mm and a thickness of 10 μm. The diameter of the independent wire 105 was set to 6.3 mm. The independent wire lead portion A 107 was disposed on the outermost side of the driving connection lead portions 3-1 and 3-2, at the position having the same pitch as the driving connection lead portion so as to extend to the outside by using a flexible wire to be later described and at the position allowing the independent wire lead portion to be extended to the outer side (atmospheric air side) of the outer frame 4, as shown in FIGS. 4 and 5. The independent wire lead portion B 108 was disposed on the outer side (atmospheric air side) of the outer frame 4 as shown in FIG. 5. The driving connection lead portions and independent wire lead portions are buried in frit to be used later at the outer frame sealing process to thereby maintain a hermetically sealed vacuum state.

(Process C)

Next, by using paste having PbO as its main component and mixed with glass binder, an insulating layer 24 is formed by printing. This insulating layer 24 electrically insulates the Y-direction connection lines 23 from X-direction connection lines to be described later, and has a thickness of about 20 μm. A recess 24C is formed in the insulating layer at the position corresponding to the device electrode 22 to electrically connect the X-direction connection lines and device electrodes (FIG. 3C).

(Process D)

Figure 3D:
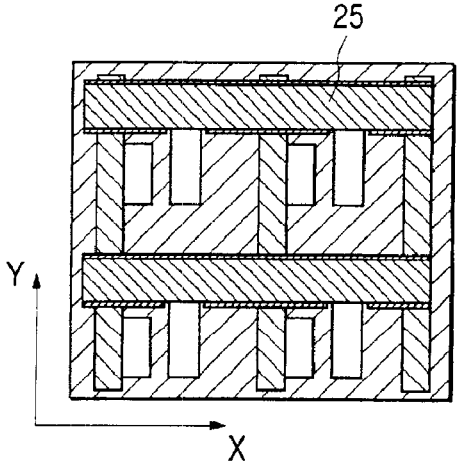

Next, the X-direction connection lines 25 as the scanning connection lines are formed on the insulating layer 24 (FIG. 3D). The line forming method is similar to that for the Y-direction connection lines. The X-direction connection line has a width of 300 μm and a thickness of about 10 μm. The Y-direction connection line extends to the outside of the electron source area and the extended portion becomes the driving connection lead portion 3-1 shown in FIG. 1.

Figure 3E:
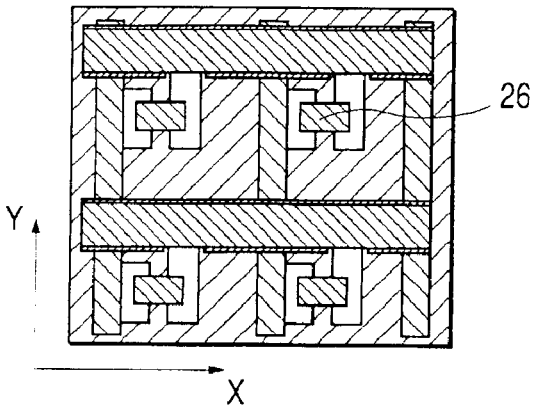

Next, organic Pd solution is coated and baked in the atmospheric air for 12 minutes at 300° C. to form a PdO fine particle film 26 (FIG. 3E).

After the above-described processes, the rear plate 1 has four corners not formed with connection leads as shown in FIGS. 1 and 4. An independent wire 105 is disposed concentrically surrounding the lead-in wire 101 of the hermetically sealed lead-in terminal 103 in one corner surrounded by the driving connection lead portions 3-1 and 3-2, the independent wire being formed by coating Ag paste by a printing process and baking it. A high resistance film (a nitride film of alloy of W and Ge) is formed by vapor deposition, electrically connecting the lead-wire 101 of the hermetically sealed lead-in terminal 103 and the independent wire 105. The connection lead 100 of the face plate 11 is positioned facing the through hole 104. The W—Ge alloy nitride film was formed by sputtering W and Ge targets at the same time in a sputtering system in a mixed atmosphere of argon and nitrogen. In order to form the independent wire at the position shown in FIG. 4, a metal mask etched to have the shape of the independent wire 105 was used. An optimum resistance value was obtained by adjusting contents of targets by changing the power supplied to the targets. More specifically, a mixed gas of argon and nitrogen was flowed under the conditions of a sputter chamber back pressure of $2\times10^{-5}$ Pa and a nitrogen partial pressure of 30% during sputtering. The total pressure of sputter gas was 0.45 Pa. The W—Ge alloy nitride film was formed by adjusting a sputtering time while a high frequency power of 15 W is applied to the W target and 150 W to the Ge target. Three types of the W—Ge alloy nitride film were formed, having (a film thickness of 43 nm, a specific resistance of 250 Ωcm and a sheet resistance of $5.8\times10^{9}$ Ω/□, (a film thickness of 200 nm, a specific resistance of $2.4\times10^{5}$ Ωcm and a sheet resistance of $1.2\times10^{12}$ Ω/□, and (a film thickness of 80 nm, a specific resistance of $4.5\times10^{8}$ Ωcm and a sheet resistance of $5.6\times10^{15}$ Ω/□, respectively. In this embodiment, although the W—Ge alloy nitride film was formed only between the lead-in wire 101 and independent wire 105, it may be formed in the peripheral area outside of the independent wire 105.

Next, a panel or vacuum chamber is formed by using the rear plate 1, face plate 11, outer frame 4 and the like. In the assembly, the phosphor of the image forming member 12 of the face plate 11 and the electron-emitting devices of the rear plate 1 are aligned precisely in position. The hermetically sealed lead-in terminal 103 and glass tube 6 are mounted on the panel with position alignment, and the panel is placed in a heating furnace at a temperature of 420° C. to melt frit glass 201 coated in the abutment areas of the face plate 11, rear plate 1 and outer frame 4. Thereafter, the panel is cooled to complete the assembly capable of maintaining a hermetically sealed state and having the face plate 11, rear plate 1, outer frame 4, glass tube 6 and hermetically sealed lead-in terminal 103. Thereafter, the panel is connected via the glass tube 6 to an evacuation system to evacuate the inside of the panel, and then an energization forming operation and an activation operation are performed for the fine particle films 26. Next, while the evacuation of the inside of the panel is maintained, a baking process is performed to remove organic molecular substance left in the vacuum panel. Lastly, the glass tube 6 is heated to be melt and sealed. With the above processes, the vacuum panel is completed.

Next, FPC's (abbreviation for flexible printed circuit) 401 are electrically connected and mechanically fixed in order to connect the driving connection lead portions 3-1 and 3-2 to a driver circuit board, and to connect the independent wire lead portion A 107 to an external ground terminal. For this connection, an FPC mount apparatus is used. In order to realize a more stable connection to the external ground terminal, the independent wire lead portion B 108 is also connected to a ground terminal by mounting a clip in contact with the ground terminal on the rear plate 102. Thereafter, the vacuum panel is assembled in the housing and electric circuit boards and FPC's are connected to complete a plane type image-forming apparatus.

FIG. 6A is a diagram briefly showing the internal structure of a plane type image-forming apparatus with the vacuum container being assembled in the housing, FIG. 6B is a sectional side view taken along an arrow A direction of FIG. 6A, and FIG. 6C is a transverse sectional view taken along an arrow B direction of FIG. 6A. In FIGS. 6A to 6C, reference numeral 601 represents a cover constituting the housing. Reference numeral 602 represents a vacuum container, and reference numeral 603 represents a driver circuit board having a driver circuit. The driving connection lead portions and driver circuit are connected by FPC's 401. Reference numeral 605 represents a high voltage introducing path connected to the lead-in wire 101. Reference numeral 600 represents a high voltage source for generating an acceleration potential.

By using the image-forming apparatus of this embodiment, an external video signal is input to drive the electron-emitting devices and display an image. Abnormal discharge did not occur and an image could be displayed stably.

It was able to realize an electron-emitting apparatus and an image-forming apparatus having a narrow outer frame area and to realize an electron-emitting apparatus and an image-forming apparatus light in weight.

(Second Embodiment)

Figure 7:
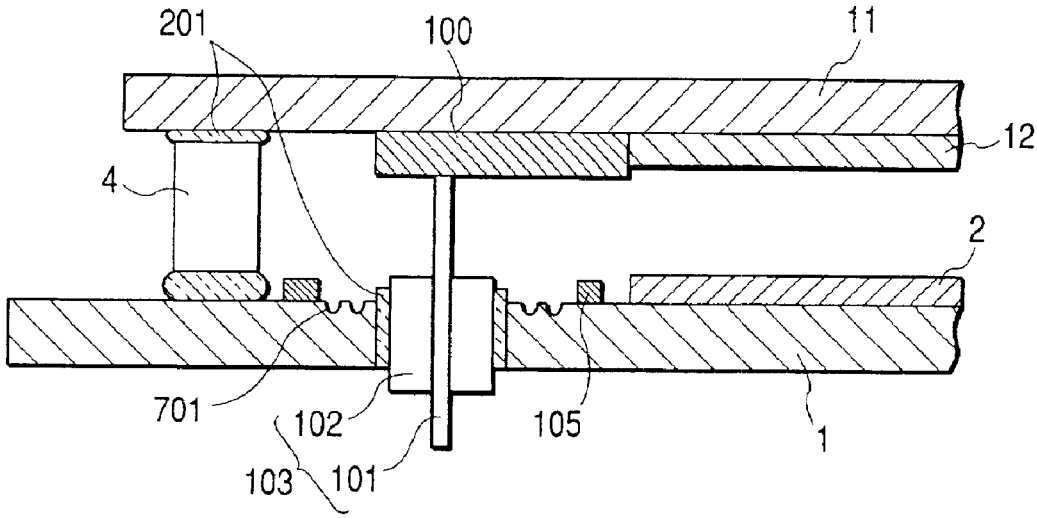
FIG. 7 is a sectional view showing an anode terminal unit taken along an arrow direction of FIG. 1 according to a second embodiment.

The second embodiment will be described with reference to FIG. 7. FIG. 7 is a sectional view particularly showing the anode terminal unit, taken along the arrow A direction shown in FIG. 1.

In the second embodiment, the dielectric breakdown proof structure between the independent wire 105 and hermetically sealed lead-in terminal 103 will be described. In FIG. 7, like elements to those of the first embodiment are represented by using identical reference symbols, and the description, structure and manufacture method therefor are omitted.

The glass surface of the rear plate 1 surrounding the lead-in wire 101 of the hermetically sealed lead-in terminal 103 and the independent wire 105 concentrically surrounding the lead-in wire 101 is mechanically worked to form a dielectric breakdown proof structure 701. This structure is formed by forming concentrical double trenches around the hermetically sealed lead-in terminal 103. The trenches had a depth of 0.5 mm relative to the glass thickness of 2.8 mm, the radius of curvature of 0.5 mm, and a pitch of 1.5 mm. With this structure, the creepage distance can be substantially elongated. A vacuum panel with this dielectric breakdown proof structure 701 was assembled to form a plane type image-forming apparatus such as shown in FIG. 6. The apparatus was driven and an image was displayed. Discharge did not occur and the apparatus was able to be driven stably.

As described above, with the embodiment structure, the dielectric breakdown proof structure is formed beforehand on the rear plate 1 side. It is therefore possible to provide a flat type image-forming apparatus which can minimize the number of vacuum panel forming processes and is light in weight.

(Third Embodiment)

In this embodiment, the vacuum container of an electron-emitting apparatus has a distance between the rear and face plates as short as several mm. It is therefore difficult to have a sufficient space for mounting the structure of supplying an acceleration potential to an image forming acceleration electrode of the face plate. If this space is made small, a possibility of abnormal discharge becomes high.

As described in the above embodiments and as will be described in the following embodiments, such a problem can be solved by using the structure capable of suppressing abnormal discharge along an acceleration potential supply path. More specifically, the intermediate area of the acceleration potential supply path of an electron source substrate is coated with a first wire given a predetermined potential, and in addition a resistor film is formed for electrically connecting the intermediate area and first wire.

If the vacuum chamber is used with an electron-emitting apparatus or an image-forming apparatus, it is desired to vigorously study the structure of applying a predetermined potential, particularly a ground potential, to the first wire.

In the following embodiment, the structure of supplying a predetermined potential, particularly a ground potential, will be described.

In this embodiment, a display having a thin plane type image display panel using electron-emitting devices is adopted. In the acceleration potential supply path from the high voltage source to the acceleration electrode of the face plate in the vacuum container, a hermetically sealed lead-in terminal is provided for applying an acceleration potential to the rear plate constituting the vacuum container, a dielectric breakdown proof structure of a high resistance film formed around the lead-in wire is provided, and a ring-shape independent wire is formed around the lead-in wire.

In order to ensure the earth potential of the independent wire, a portion of the independent wire is connected to the earth line of FPC grounded to the earth potential of a driver circuit, and in addition, the independent connection lead portion and a front frame connected to the earth potential of a power source unit are made in contact with each other by using a contactor which is a conductive contact member. Namely, the first wire is grounded via the frame serving also as a cover which covers at least a portion of the components of the vacuum container. The contactor is resilient and is fixed to the front frame, for example, by a screw so that the contactor always pushes the independent wire lead portion. The contact position between the contactor and independent wire lead portion is aligned by squeezing the vacuum container with the front frame and middle frame with elastic material being interposed therebetween.

In this embodiment, the structure regarding the vacuum container and electron emission, such as the electron source substrate, electron-emitting devices, acceleration electrode substrate, an acceleration electrode, driving connection leads, an acceleration potential supply path, is similar to that of the first and second embodiments.

The operation principle is also similar to that of the first and second embodiments. Of the substrates facing in vacuum space, the rear plate (RP) is formed with electron-emitting devices at pixel positions. As the electron-emitting device, a surface conduction electron-emitting device is used. The surface conduction electron-emitting device has a pair of device electrodes (high potential side electrode and low potential side electrode) for electron emission spaced apart by several tens $\mu$m, and a conductive film connected between the opposing electrodes to make an electron-emitting region in the conductive film.

On the vacuum space side of the opposing face plate (FP), black stripe films for improving contrast, phosphor films of three primary colors RGB are formed, and on these films, a conductive metal back film is formed as an acceleration electrode.

In operation of the electron-emitting element, a voltage of several tens V is applied across the X-direction connection line and Y-direction connection line selected by an electrical circuit (driver circuit) to make the electron-emitting device emit electrons. These emitted electrons are accelerated by a positive potential (acceleration potential) in the order of ten and several kV applied to the metal back film of the face plate on the vacuum space side from an external high voltage source.

A flexible cable interconnecting the rear plate and the electrical circuit is electrically and mechanically connected by a connector on the electrical circuit side, and on the rear plate side, it is electrically and mechanically connected to the electrode portions (ends of the connection lead portions) of the X- and Y-direction connection lines made of anisotropic conductive films printed on the rear plate.

A high voltage cable interconnecting the metal back of the face plate and the high voltage power source circuit are electrically and mechanically connected to a high voltage connector on the high voltage power source side, and on the face plate side, they are electrically and mechanically connected to the metal back via the hermetically sealed lead-in terminal made of an integrated conductive wire and insulator disposed in the through hole formed in the rear plate.

The embodiment will be described in detail with reference to the accompanying drawing. The size, material, shape, relative position and the like of each component described in this embodiment are not intended to be limitative and the scope of the invention is not limited only thereto, unless otherwise specifically described.

In the following drawings, similar elements to those already shown in the previous drawings are represented by using identical reference numerals.

Figure 8:
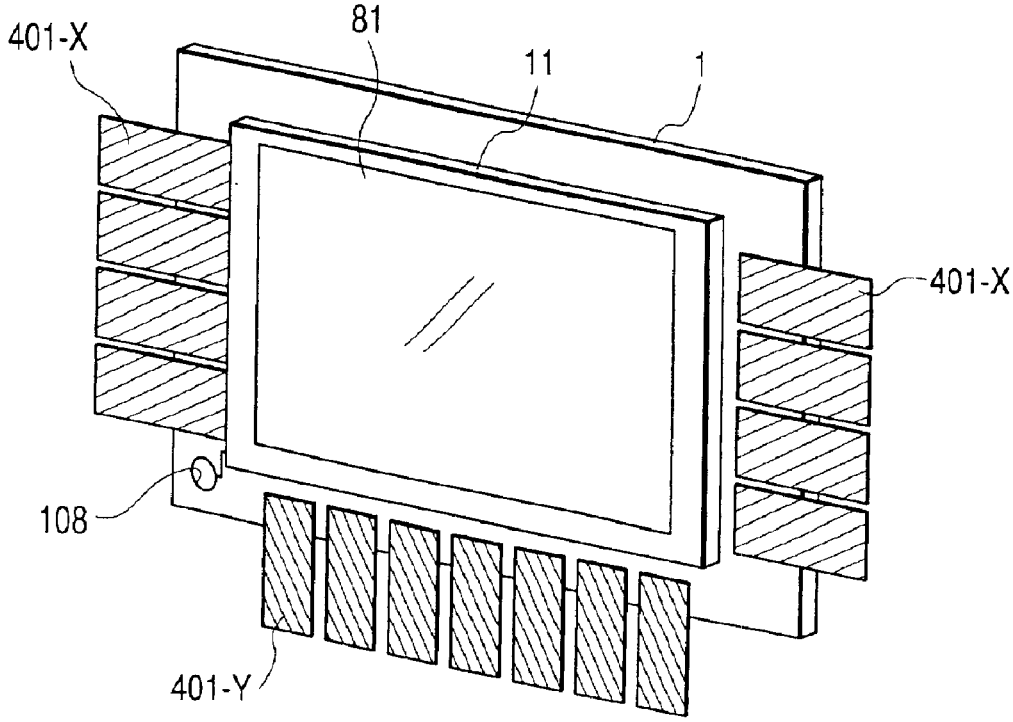
FIG. 8 is a perspective view of an image display unit of an image display apparatus according to a third embodiment of the invention.
Figure 9:
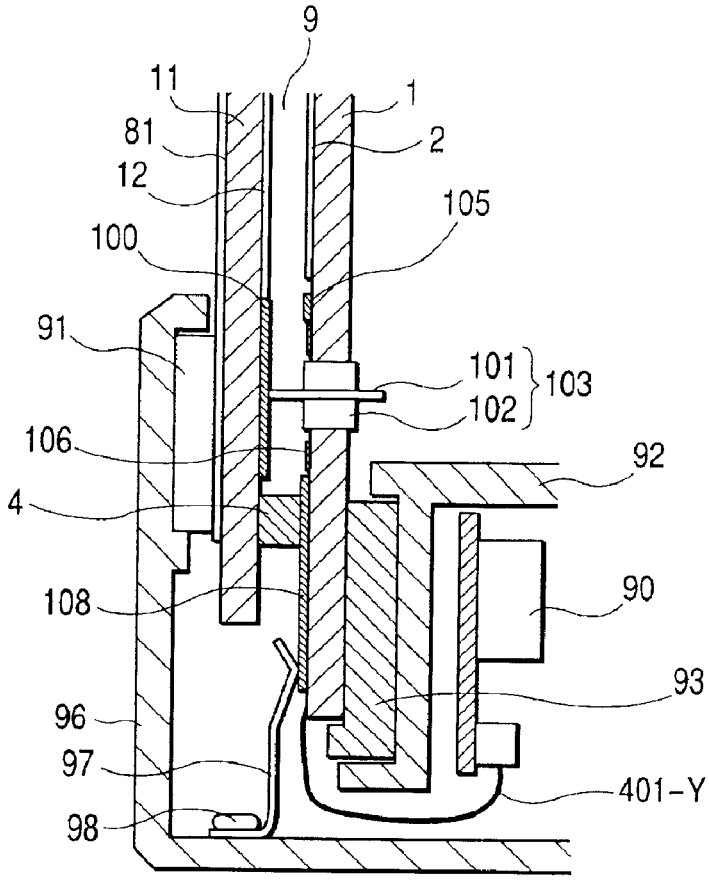
FIG. 9 is a traverse sectional view showing the main part of the image display unit of the image display apparatus shown in FIG. 8.
Figure 10:
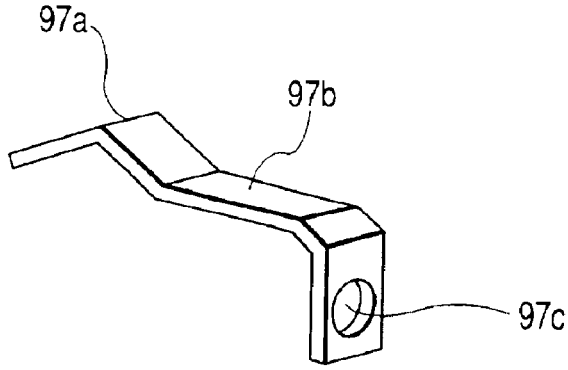
FIG. 10 is an enlarged view of a component of the image display apparatus shown in FIG. 8.

An image display apparatus according to the third embodiment of the invention will be described with reference to FIG. 5 and FIGS. 8 to 10. FIG. 8 is a perspective view of an image display unit of an image display apparatus according to the third embodiment of the invention, FIG. 9 is a traverse sectional view showing the main part of the image display unit of the image display apparatus shown in FIG. 8, and FIG. 10 is an enlarged view of a component of the image display apparatus shown in FIG. 8.

Reference numeral 1 represents a rear plate (hereinafter also called RP) constituting a vacuum container of an image display panel using electron-emitting devices according to the invention. A driving connection pattern and an insulating film are formed on the glass substrate of the rear plate.

Reference numeral 11 represents a face plate (hereinafter also called FP) constituting the vacuum container. On the glass substrate of the face plate on the inner side of the vacuum container, a metal back film as an acceleration electrode and the like are formed.

Reference numeral 4 represents a support frame constituting the vacuum container according to the invention. RP 1 and FP 11 are coupled by this frame 4 by using low melting glass. Reference numeral 9 represents a vacuum space of the vacuum container.

Reference numeral 103 represents a hermetically sealed lead-in terminal having a high voltage lead-in wire 101 made of alloy and an insulating member 102 made of alumina ceramics in the central area with which the high voltage lead-in wire is integrated to be followed by a vacuum hermetic sealing process. Reference numeral 106 represents a dielectric breakdown proof structure made of a resistor film which is made of a nitride film of W—Ge alloy formed between the lead-in wire 101 and an independent wire 105 through vacuum vapor deposition for the electrical connection therebetween. Reference numeral 108 represents a lead portion of the first wire 105 of this invention which is formed by printing Ag paste in a predetermined shape and baking it.

The independent wire 105 also has straight lead portions capable of being connected to the earth lines of a Y-direction FPC 401 and an X-direction FPC 401.

401-X represents the X-direction FPC for sending an electric driving signal (scan signal) for image display from the driver circuit to the electron source area 2. The driver circuit side of the X-direction FPC is connected by a connector, and the image display side is connected to the X driving connection lead portion 3-1 via an isotropic conductive tape. 401-Y represents the Y-direction FPC for sending a modulation signal to the electron source area 2. The driver circuit side of the Y-direction FPC is connected by a connector, and the image display side is connected to the Y driving connection lead portion 3-2 via an anisotropic conductive tape.

Reference numeral 96 represents a front frame serving as a cover. The front frame surrounds the area which is not the image display area, and also serves as a cover for preventing foreign matters from entering and supporting the vacuum container from the front side. The front frame is formed by extruding light metal such as aluminum and magnesium, shaping it, and cutting it into a predetermined length. The front frame is fixed by screws to form a generally rectangular frame. The front frame is electrically connected to the earth potential of the power source unit.

Reference numeral 97 represents a conductive contactor having conductivity and resilient. The contactor is formed by bending a thin plate made of stainless steel, plated phosphor bronze or the like. One end of the contactor is fixed to the inner wall of the front frame 96, and the other end is electrically connected to the lead portion 108 of the independent wire.

Reference numeral 98 represents a screw for fixing the contactor 97 to the inner wall of the front frame 96. Reference numeral 81 represents a front film attached to the outer surface of the vacuum container on the FP 11 side with adhesive and covering the image display unit. The front surface of the front film is subjected to a low reflection process. Reference numeral 92 represents a middle frame positioned on the back surface side of the vacuum container. The middle frame has rigidity in order to support and fix the vacuum container in the housing, and is disposed like a frame along the four sides of the vacuum container. The middle frame is formed by extruding light metal such as aluminum and magnesium, shaping it, and cutting it into a predetermined length. The middle frame is fixed by screws to form a generally rectangular frame. Reference numeral 93 represents a back elastic member made of elastic material such as urethane foaming resin and silicon foaming resin. The back elastic member supports RP 1 of the vacuum container which is squeezed by the middle frame 92. A peripheral projection of the back elastic member contacts the outer periphery of RP 1 and positioned between the ribs of the middle frame 92.

Reference numeral 90 represents a driver circuit for generating an electrical driving signal (for line sequential selection drive, modulation is assumed to be the pulse width modulation) for image display. The driver circuit is formed on a glass epoxy substrate on which electronic components such as IC's, capacitors, and connectors are formed. Reference numeral 91 represents a front elastic member made of elastic material such as urethane foaming resin and silicon foaming resin. The front elastic member supports FP 11 of the vacuum container which is squeezed by the outer frame 96. The front elastic member covers the four sides of FP 11 and has a frame shape.

Next, the operation of the image display panel constructed as above will be detailed. The image display panel of the embodiment uses the vacuum container made of glass. The electron source area 2 on the RP 1 side emits electrons. A high voltage of ten and several kV is applied to the image forming member 12 (metal back layer) on the inner wall of FP 11 to accelerate electrons and make them collide with the phosphor of the image forming unit 6 so that light is emitted from the phosphor and an image is displayed. Since the electron-emitting device is driven near at the ground potential, the acceleration voltage is substantially ten and several kV.

The glass of RP1 and FP 11 constituting the vacuum container has a thickness of about 2.8 mm, and the vacuum space between RP 1 and FP 11 is about 2 mm. As compared to a CRT having the same screen size, this thin and light image display panel has one several tenth of the thickness and one several-th of the weight.

In order to display a moving image of a television or a personal computer, the electrical driving signal (modulation signal) generated by the driver circuit 90 is sent to the surface conduction electron-emitting devices in the electron source area 2 via the Y-direction FPC 401-Y and Y driving connection lead portion 3-2. An electrical driving signal (scan signal) generated by an X-direction driver circuit is sent to the surface conduction electron-emitting devices in the electron source area 2 via the X-direction FPC 401-X and X driving connection lead portion 3-1. In this manner, emission of electrons from the surface conduction electron-emitting device of each pixel can be controlled.

With the above structure, the image display panel of the embodiment can be made thinner as compared to the vacuum container of CRT which requires a space to accelerate and deflect electrons emitted from one to three electron guns.

The acceleration potential for making electrons emitted from the surface conduction electron-emitting device collide with the phosphor is applied to the metal back of the image forming member 12 from the high voltage source 600 via the high voltage cable 605 (FIGS. 6A to 6C), lead-in wire 101 of RP1, and a high voltage connection lead 100 of FP 11.

Since a potential of ten and several kV is applied to the potential supply path, components and peripheral components along this path are required to have the dielectric breakdown proof structure. This dielectric breakdown proof structure is similar to that of the first and second embodiments.

In this embodiment, in order to ensure the earth potential, the independent wire 105, Y-direction FPC 401-Y and X-direction FPC 401-X are connected to make the independent wire be connected to the earth patterns of the driver circuit 90 and X-direction driver circuit. In addition, the independent wire lead portion 108 of the ring shape independent wire 105 is made in contact with the resilient contactor 97 made of elastic metal as the conductive contact member constituting the component of the invention, and electrically connected to the earth potential of a power source unit via the conductive front frame 96.

The contactor 97 is reliably fixed by a screw meshed with an internal thread formed through the front frame 96 by using a fixed hole 97*c*.

In the state that the vacuum container is mounted on the front frame 96, a spring portion 97*b* of the contactor 97 makes a contact portion 97*a* always push the independent wire lead portion 108 on the surface of RP 1. Therefore, even if there are a change in an environment temperature and a secular change, the electrical connection can be retained. Further, when the vacuum chamber is assembled in the front frame 96, the contactor 97 is fixed in advance to the front frame 96 with the screw 98. Therefore, a wiring work such as soldering is not required and after the assembly, the electrical connection structure is already completed. The assembly work is therefore efficient.

The structure of the contactor 97 is not limited to the above structure, but any other structure may be used so long as it provides an electrical contact portion (fixed portion) to the frame (front frame 96) and provides conductivity and resilience (elasticity).

As the support structure for the vacuum container of this invention, the four peripheral sides of the vacuum container are squeezed by the middle frame 92 and front frame 96 via the back and front elastic members 93 and 91. As the support structure for a thin image-displaying apparatus, a rear glass (corresponding to RP 1 of this invention) of the image display unit may be adhered to the housing frame by a both-side adhesive tape. However, with the support structure of this embodiment, the front frame 96 and middle frames 92 can be fixed with screws. When the image display panel is to be disassembled, the screws are removed to dismount the vacuum container so that the work efficiency is high.

The middle frame 92 and front frame 96 are each formed by extruding light metal having a thickness of thinner than 2 mm such as aluminum and magnesium, shaping it, and cutting it into a predetermined length. The middle frame and front frame are fixed by screws to form generally rectangular frames. The middle and front frames have rigidity and protect the vacuum container from an external mechanical load. Since the position of the vacuum container relative to the front frame 96 is hard to be altered, the positions of the contactor 97 and independent wire lead portion 108 are hard to be altered and the pushing force of the contactor 97 is stable. Therefore, the earth potential area near the hermetically sealed lead-in terminal 103 of the vacuum container can be reliably connected to the earth potential.

According to the invention, the housing is made of worked conductive metal such as the front frame 96 and connected to the earth potential. If the frame is made of nonconductive material such as resin, the necessary surface (e.g., inner surface) is subjected to a conductive film process to use the frame like the conductive material frame (metal frame).

As described above, according to the embodiment, in the high potential supply path from the high voltage source to the acceleration electrode in the vacuum container, the dielectric breakdown proof structure 106 made of the high resistance film electrically connected to the lead-in wire 101 is provided around the lead-in wire in the vacuum container and the ring-shape independent wire 105 at the earth potential electrically connected to the high resistance film is provided. In this way, abnormal discharge can be suppressed so that it is possible to suppress the electron-emitting devices from being deteriorated or broken.

In order to ensure the earth potential of the independent wire, portions of the independent wire are connected to the earth lines of X- and Y-direction FPC 401-X and 401-Y connected to the earth patterns of X- and Y-direction driver circuits, and further the lead portion 108 of the independent wire 105 is made in contact with the contactor 97 which is fixed to the front frame connected to the earth potential of the power source unit.

Since the contactor fixed to the front frame 96 has resilience, the contactor always pushes the lead portion 108 of the independent wire 105. Therefore, by assembling the vacuum container in the front frame, an electrical connection can be retained without a wiring work such as soldering. Even if there are a change in an environment temperature and a secular change, the electrical connection can be retained.

Further, the image display unit is squeezed and supported by the front frame 96 on the front side and the middle frame 92 on the back side via the front and back elastic members 91 and 93 as elastic buffers of the constituent element of the invention. Therefore, the image display unit can be protected from an external mechanical load. Since the positions of the front frame 96 and image display unit are fixed, the contact position between the contactor 97 and lead-in portion 108 of the independent wire 105 becomes stable.

(Fourth Embodiment)

In this embodiment, in order to ensure the earth potential of the independent wire, portions of the independent wire are connected to the earth lines of FPC's connected to the earth potential of the driver circuits, and further the lead-in portion of the independent wire is squeezed by a contact plate soldered to an earth cable connected to the earth potential of the power source unit. The earth cable and contact plate are also used to inspect the driving operation of the image display unit during the manufacture processes for the image-displaying apparatus, and after the product assembly, the power source unit is connected to the earth potential.

Figure 11:
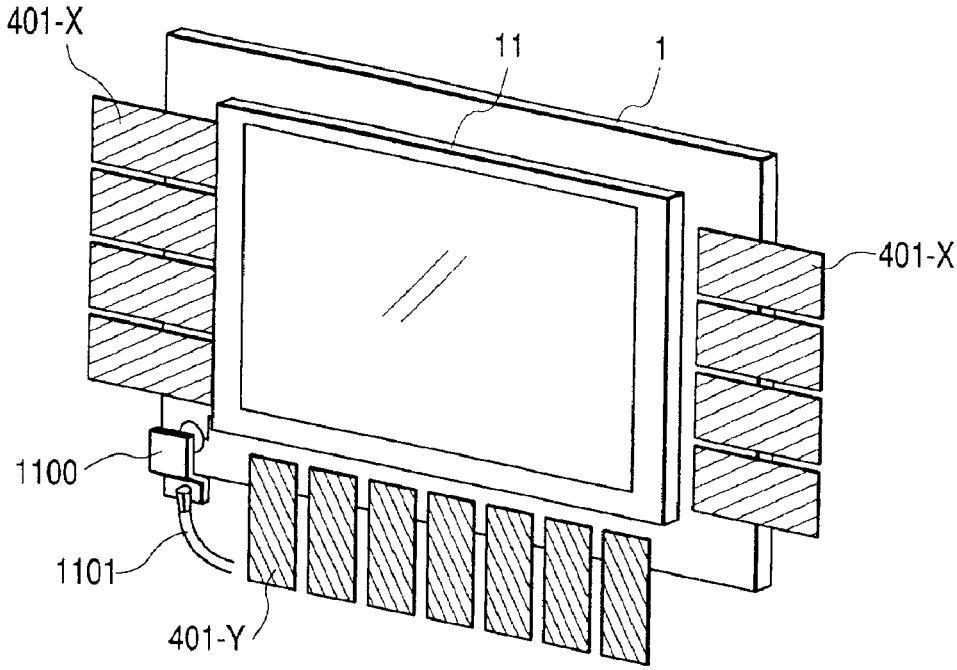
FIG. 11 is a perspective view of an image display unit of an image display apparatus according to a fourth embodiment of the invention.

The image-displaying apparatus according to the fourth embodiment of the invention will be described with reference to FIGS. 11 and 12. FIG. 11 is a perspective view of an image display unit of an image display apparatus according to the fourth embodiment of the invention, and FIG. 12 is a traverse sectional view showing the main part of the image display unit of the image display apparatus shown in FIG. 11.

Figure 12:
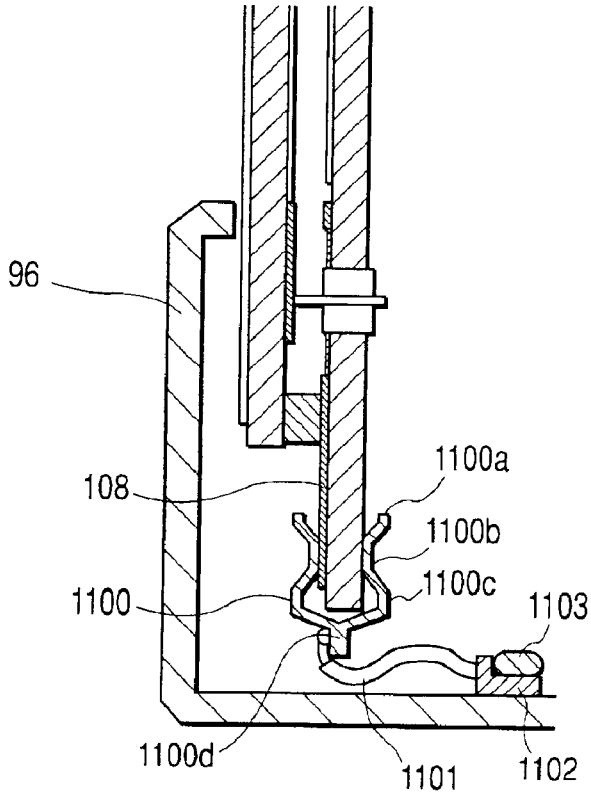
FIG. 12 is a traverse sectional view showing the main part of the image display unit of the image display apparatus shown in FIG. 11.

In FIGS. 11 and 12, the reference numeral 1100 represents a contact plate which squeezes RP 1 constituting the vacuum container of the image display panel using electron-emitting devices and is electrically connected to the independent wire lead-in portion 108 on RP 1. The contact plate is made of material having conductivity and resilience and formed by bending a thin plate (thickness of 0.2 mm to 0.5 mm) such as stainless steel and phosphor bronze subjected to a plating process (anticorrosion process).

Reference numeral 1100*a* represents a tip portion of the contact plate having a right/left symmetrical shape as shown in the traverse sectional view of FIG. 12 showing the main portion. Reference numeral 1100*b* represents a contact portion of the contact plate, reference numeral 1100*c* represents a resilient portion of the contact plate, and reference numeral 1100*d* represents a terminal portion of the contact plate.

Reference numeral 1101 represents an earth cable. One end of the earth cable is electrically and mechanically connected to the contact plate 1100 by soldering, and the other end is connected to a terminal 1102 having a through hole. A screw 1103 is inserted into the through hole of the terminal 1102.

The screw 1103 fixes the terminal 1102, by utilizing the internal thread formed in the front frame 96. The earth cable 1101, contact plate 1100 and independent wire lead-in portion 108 are all applied with the earth potential via the front frame 96 which is electrically connected to the earth potential of the power source unit.

The features of this structure will be described. The contact plate 1100 as the conductive contact member of the constituent element of the invention made of elastic metal, squeezes RP 1. In the state before squeezing RP 1, the tip portions 1100*a* of the contact plate 1100 have a shape opening broader than the thickness of RP1 so that the tip portions 1100*a* provide the guide function when the contact plate 1100 is mounted on RP1 along its outer peripheral direction, e.g., along an upward direction as viewed in FIG. 12.

In the state before squeezing RP 1, the contact portions 1100*b* have a distance shorter than the thickness of RP1 (1.5 to 2 mm relative to the RP 1 thickness of 2.8 mm), and while squeezing RP1, they are made wider by the thickness of RP 1.

Namely, the contact plate 1100 has two opposing sides, the opening width between the tip portions of the two opposing sides is wider than the thickness of PR1 and the distance between the contact portions of the two opposing sides is shorter than the thickness of PR 1.

The spring portions 1100*c* has the shape that allows the contact portions 1100*b* widened by the thickness of RP 1 to have a pressure always squeezing RP1. The terminal portion 1100*d* has a flat area for soldering the earth cable 1101. The terminal portion 1100*d* may be provided with a hole through which core wires of the earth cable 1101 pass and with a recess around which the core wires are wound.

In this embodiment, for the earth potential of the independent wire lead-in portion 108 on RP 1 constituting the vacuum container, the contact plate 1100 for squeezing RP 1 and-the earth cable 1101 are used. During the manufacture processes for the image-displaying apparatus, the image-displaying apparatus is required in some cases to be electrically driven for image display inspection, before the vacuum container is assembled in the front frame. In such a case, it is preferable to supply an earth potential to the independent wire lead-in portion 108 of RP 1. To this end, the terminal 1102 at one end of the earth cable 1101 is connected to the earth terminal of a driver circuit during manufacturing processes. Namely, the contact plate 1100 for squeezing RP 1 and the earth cable 1101 may be used for supplying an earth potential during manufacture processes for the image-displaying apparatus. Thereafter, at the final assembly, the contact plate and earth cable are mounted on the front frame to complete the product.

With this structure, it is preferable to adopt a method of supporting the vacuum container by adhering the RP 1 to the rear frame of the housing by using a both-side adhesive tape, alternatively, the vacuum container may be squeezed between the front and rear sides similar to the third embodiment. Various vacuum container support methods are therefore applicable.

As described above, the embodiment can suppress abnormal discharge. The independent wire 105 is connected to the earth lines of X- and Y-direction FPC's connected to the earth patterns of X- and Y-direction driver circuits, and further the contact plate 1100 squeezes the independent wire lead-in portion 108, the contact plate 1100 being soldered to one end of the earth cable whose other end is connected to the terminal fixed with the screw to the front frame connected to the earth potential of the power source unit. It is therefore possible to set the earth potential of the independent wire reliably. The contact plate 1100 squeezing the independent wire lead-in portion 108 for electrical connection and the earth cable can be used for a driving test of the image display unit during the manufacture processes of the image-displaying apparatus. After the product assembly, the earth potential at the independent wire lead-in portion can be obtained without any wiring work. Even if there are a change in an environment temperature and a secular change, electrical connection can be retained. By introducing this earth connection structure, the vacuum container can be supported by various methods, such as squeezing it by the front and rear frames, and adhering RP 1 to the housing frame. The degree of design freedom can thus be increased.

(Fifth Embodiment)

In order to ensure the earth potential of the independent wire, the independent wire is connected to the earth lines of FPC's connected to the earth potential of the driver circuits, and further the independent wire lead-in portion is connected to the earth potential via a front frame connected to the earth potential of the power source unit, a probe, a conductive layer of a front film, and a conductive contact tape. The probe supported by a front elastic member fitted in the front frame always pushes the conductive layer of the front film covering the front surface of the vacuum container. The contact tape can establish an electric connection manually without using any tool. This earth connection structure partially uses the conductive layer of the front film to provide the structure of reducing leakage of unnecessary electromagnetic waves. The vacuum container is squeezed between the front and middle frames via elastic members to support it and fix its position.

Figure 13:
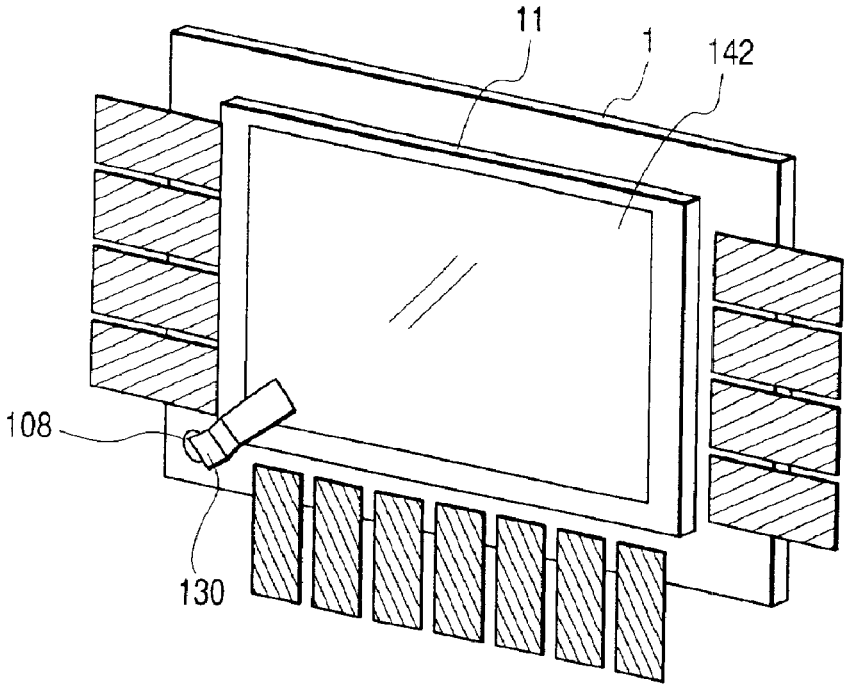
FIG. 13 is a perspective view of an image display unit of an image display apparatus according to a fifth embodiment of the invention.
Figure 14:
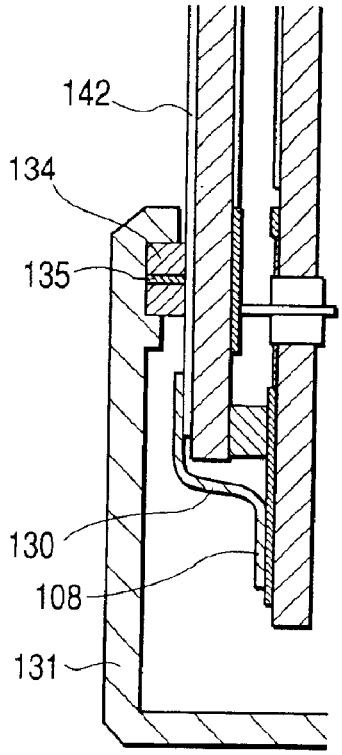
FIG. 14 is a traverse sectional view showing the main part of the image display unit of the image display apparatus shown in FIG. 13.

With reference to FIGS. 13 and 14, an image display apparatus according to the fifth embodiment of the invention will be described. FIG. 13 is a perspective view of an image display unit of an image display apparatus according to the fifth embodiment of the invention, and FIG. 14 is a traverse sectional view showing the main part of the image display unit of the image display apparatus shown in FIG. 13.

In FIGS. 13 and 14, reference numeral 130 represents a contact tape as a conductive contact member of the constituent element of the invention. The contact tape is formed by coating conductive pressure sensitive adhesive which contains carbon on a copper foil having a thickness of about 0.05 mm. One pressure sensitive adhesive surface is adhered to the surface of the independent wire lead-in portion 108 on RP 1, and the other pressure sensitive adhesive surface is adhered to the conductive front film 142 to be described later attached to RP11.

Reference numeral 131 represents the front frame which surrounds the area which is not the image display area, prevents foreign matters from entering and supports the vacuum container from the front side. The front frame is formed by extruding light metal such as aluminum and magnesium, shaping it, and cutting it into a predetermined length. The front frame is fixed by screws to form a generally rectangular frame. The front frame is electrically connected to the earth potential of the power source unit. Reference numeral 134 represents a front elastic member integrally formed with the probe 135 as the connection member in order to support it in the central area. The front elastic member is made of elastic material such as urethane foaming resin and silicon foaming resin. The middle frame 92 and front frame 131 squeeze and support the vacuum container. The middle frame has the similar structure to that shown in FIG. 9, and is omitted in FIG. 14.

One object of the front elastic member 134 is to provide a buffer function when FP 11 of the vacuum container is squeezed and supported by the front frame 131. The front elastic member covers the four sides of FP 11 and has a frame shape. The probe 135 is linearly disposed supported by the front elastic member 134. The probe 135 is made of a metal wire of gold plated brass or stainless steel.

One end of the probe 135 contacts the front frame 131, and the other end thereof contacts the conductive front film 142 attached to the surface of FP 11. As described earlier, the conductive front film 142 is attached to the surface of FP 11. The front film is made of a PET resin base. The surface of the PET resin base on the FP 11 side is coated with acrylic pressure sensitive adhesive, and the surface on the front surface side thereof is formed with an ITO layer by sputtering.

The details of this structure will be described. The earth connection structure that the earth potential is supplied to the independent wire lead-in portion 108 on RP 1 constituting the vacuum container, is constituted of the contact tape 130 adhered to the independent wire lead-in portion 108, the ITO layer of the front film 142 adhered to the contact table 130, the probe 135 in contact with the ITO layer, and the front frame 131 in contact with the probe 135. The front frame 131 is connected to the earth terminal of the power source unit so that the earth potential is supplied to the independent wire lead-in portion via the ground structure.

The contact tape 130 can be easily cut manually with a knife or a cutter at any desired position. The probe 135 is longer by about 15% than the distance between the inner wall of the front frame 131 and the ITO layer surface of the front film 142 in order to make the electrical connection reliable. Although the probe 135 is assembled in a deflected state, the probe 135 is sandwiched between opposite sides of the front elastic member 134 so that it will not fell down or will not be subjected to plastic deformation.

In this embodiment, the front surface of the vacuum container is covered with the conductive front film 142 and is connected to the earth potential via the conductive front frame 131 covering the peripheral front area of the vacuum container. Therefore, even if unnecessary electromagnetic waves are generated from electric circuits in the image display apparatus, the generally hermetically sealed structure of the front frame 131 and front film 142 at the earth potential can attenuate the electromagnetic wave level. In this case, obviously it is desired to attenuate the electromagnetic wave level on the back side of the image display apparatus by providing a back cover connected to the earth potential and to the front frame 131.

As described above, in this embodiment, the structure of suppressing abnormal discharge is realized. In addition, the potential at the independent wire is regulated by the structure in which the independent wire 105 is connected to the earth lines of X- and Y-direction FPC's connected to the earth patterns of X- and Y-direction driver circuits, and further the independent wire lead-in portion 108 is made in contact with the contact tape 130 by using the probe electrically connected to the front frame 131 connected to the earth potential of the power source unit, the conductive layer of the front film in contact with the probe, and the conductive contact tape 130 in contact with the conductive layer.

The probe 135 is supported by the front elastic member which is fitted in the front frame 131. Since the probe 135 is supported by the front frame, it is possible to electrically connect the conductive layer of the front film 142, the front frame and the probe by assembling the vacuum container in the front frame, without any wiring work such as soldering. The contact tape 130 can electrically connect the conductive layer of the front film 142 and the independent wire lead-in portion 108 manually and easily without using any tool.

The probe 135 is supported by the front elastic member, and after the vacuum container is assembled, always pushes the conductive layer of the front film 142. Therefore, electrical connection can be retained even there are a change in the environmental temperature and a secular change.

The image display unit is squeezed and supported by the front frame 131 on the front side and the middle frame 92 on the back side via the front and back elastic members. Accordingly, the image display unit can be protected from an external mechanical load.

A portion of the structure of supplying the earth potential to the independent wire utilizes the front film 142 and front frame 131 on the front side of the vacuum container, and the front film 142 and front frame 131 are connected to the earth potential. It is therefore possible to reduce leakage of unnecessary electromagnetic waves from the image display unit and electric circuits. Since the earth potential is supplied to the independent wire, the earth potential is also supplied to the unnecessary electromagnetic wave leakage reduction structure. It is therefore possible to suppress abnormal discharge and reduce leakage of unnecessary electromagnetic waves at a low cost.

(Sixth Embodiment)

In this embodiment, as a thin flat image display panel, a display using electron-emitting devices is used. Similar to the above-described embodiments, in the high potential supply path from the high voltage source to the acceleration electrode of the face plate in the vacuum container, a dielectric breakdown proof structure using a high resistance film formed around the lead wire in the vacuum container on the RP side, as well as the ring shape independent wire (first wire) at the earth potential is provided. In this embodiment, another independent wire (second wire) spaced from the acceleration electrode is formed around the image forming unit (acceleration electrode) of FP in the vacuum container. The independent wire (second wire) at the earth potential is disposed at a constant space from the generally rectangular acceleration electrode and has a shape matching the generally rectangular acceleration electrode. In order to reliably define the earth potential of both independent wires (first and second wires), the RP independent wire is connected to the earth lines of FPC's connected to the earth potential of the driver circuits, and further a conductive contact member in contact with the inner wall of the front frame is used. The conductive contact member is in contact with the lead portions of both the RP and FP independent wires extended outside of the vacuum container to supply the earth potential, and is also electrically connected to the front frame connected to an earth potential of the power source unit. The conductive contact member is inserted and fixed in a space between FP and RP without using any fixing means such as a screw.

Figure 15:
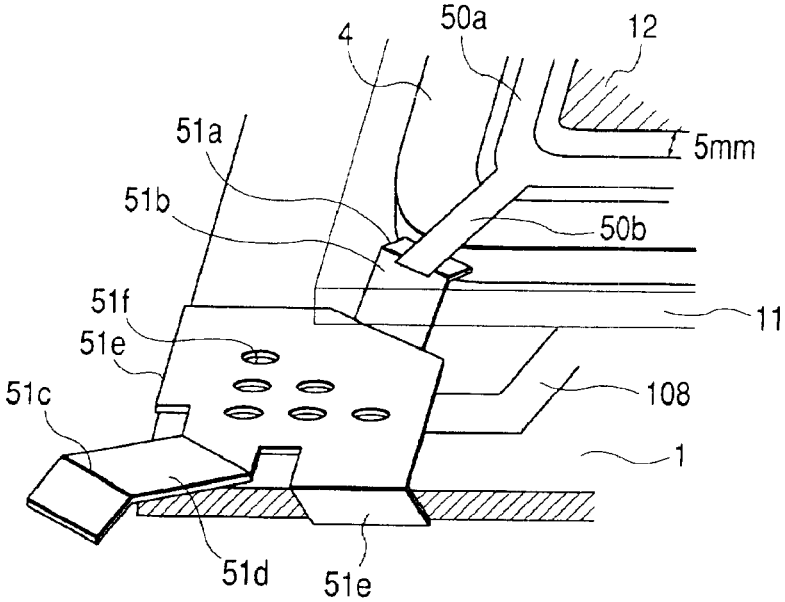
FIG. 15 is a perspective view of the corner of an image display unit of an image display apparatus according to a sixth embodiment of the invention.
Figure 16:
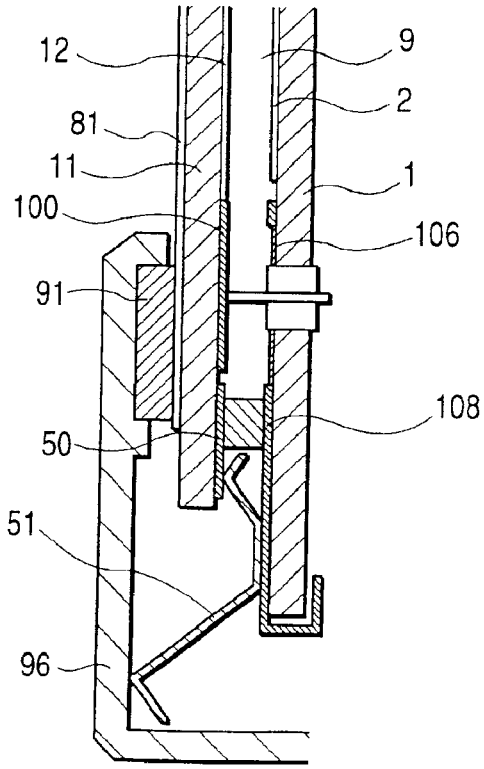
FIG. 16 is a traverse sectional view showing the corner of the image display unit of the image display apparatus shown in FIG. 15.
Figure 17:
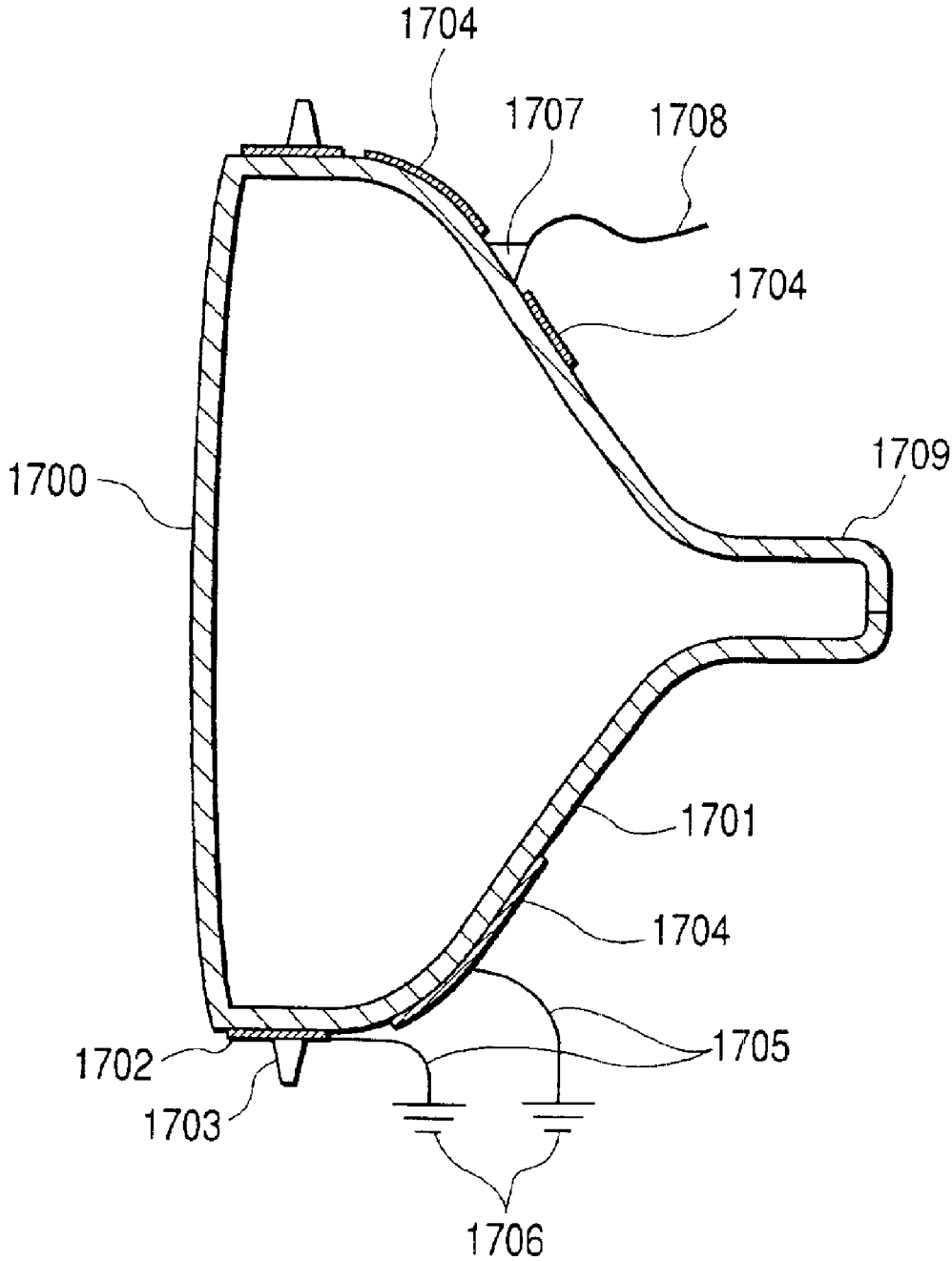
FIG. 17 is a traverse sectional view of a conventional image display apparatus.

With reference to FIGS. 15 and 16, an image display apparatus according to the sixth embodiment of the invention will be described. FIG. 15 is a perspective view of the corner of an image display unit of an image display apparatus according to the sixth embodiment of the invention, and FIG. 16 is a traverse sectional view showing the corner of the image display unit of the image display apparatus shown in FIG. 15.

Reference numeral 50 represents the FP independent wire (second wire) formed on the surface of FP 11 on the RP 1 side constituting the vacuum container of the image display panel of this embodiment. The FP independent wire is formed by printing Ag paste in a predetermined shape and baking it. Reference numeral 50*a* represents an FP independent wire vacuum portion of the FP independent wire 50 in the vacuum space 9, the FP independent wire vacuum portion having a generally rectangular shape surrounding the image forming member 12 (acceleration electrode). The FP independent wire vacuum portion is disposed spaced apart by a creepage distance of about 5 mm from the image forming member 12 and high voltage lead wire 100 applied with a high potential.

Reference numeral 50*b* represents an FP independent wire lead-in portion extended from the corner of the FP independent wire vacuum portion 50*a* to the outside of the vacuum space 9 via a junction portion between the frame 4 and FP 11. At the junction portion between the frame 4 and FP 11, the FP independent wire lead-in portion is extended to the outside, by being buried in, for example, low melting point glass, so that the vacuum hermetical sealing in the vacuum space 9 can be maintained.

Reference numeral 51 represents a contact member as the conductive contact member of a constituent element of the invention. The contact member is formed by subjecting an elastic metal thin plate to a pressing process. A contact portion 51*a* at the tip of the contact member 51 is made in electrical and mechanical contact with the FP independent wire lead-in portion 50*b*. Reference numeral 51*b* represents a spring portion of the contact member 51. The spring portion has elasticity to make the contact portion 51*a* push the FP independent wire lead-in portion 50*b*.

Reference numeral 51*c* represents a contact portion at the opposite end relative to the contact portion 51*a*. The contact portion is in electrical and mechanical contact with the inner wall of the front frame 96. Reference numeral 51*d* represents a spring portion of the contact member 51. The spring portion has elasticity to make the contact portion 51*c* push the front frame 96. Reference numeral 51*e* represents a position determining portion which squeezes RP 1 and has a channel-shaped section covering two sides of RP 1.

Reference numeral 51*f* represents a plurality of emboss portions disposed near the center area of the contact member 51. A circle shown in FIG. 15 represents a recess which is a part of a sphere, and a projection corresponding to the recess is formed on the bottom side. This projection is in electrical and mechanical contact with the independent wire lead-in portion 108. The emboss portion 51*f* always pushes the independent wire lead-in portion 108 because of elasticity of the spring portions 51*b* and 51*d*.

The features of the structure will be described. The front frame 96 is conductive and electrically connected to an earth potential of the power source unit. Therefore, the contact member in contact with the front frame 96 has the earth potential. The independent wire lead-in portion 108 in contact with the contact member 51 and the FP independent wire 50 of FP 11 have also the earth potential.

Accordingly, as described already with the above embodiments, in the vacuum space 9 of RP 1, the independence wire 105 and dielectric breakdown proof structure 106 at the earth potential can suppress abnormal discharge. It is therefore possible to prevent surface conduction electron-emitting devices from being deteriorated and broken to be otherwise caused by a large current flowing in the electron source area 2.

Further in the embodiment, the independent wire 50*a* at the earth potential in the vacuum space 9 of FP 11 surrounds the image forming member 12 and high voltage lead wire 100 applied with a high voltage, so that abnormal discharge can be suppressed. It is therefore possible to prevent surface conduction electron-emitting devices from being deteriorated and broken to be otherwise caused by a large current flowing in the electron source area 2 upon occurrence of abnormal discharge.

In assembling the contact member 51 of this embodiment, the contact portion 51*a* is inserted into a gap between RP 1 and FP 11 at the corner of the vacuum container constituting the image display panel. Next, the contact member 51 is further pushed until the two position determining portions 51*e* abut on the two side edges of RP1. In this manner, the assembly of the contact portion 51*a* is completed. Thereafter, the image display panel is assembled in the front frame 96 as shown in FIG. 16 so that the contact portion 51*c* of the contact member 51 abuts on the inner wall of the front frame 96.

As described with the above embodiments, the image display panel is squeezed by the frame on the back side or by using the adhesive means to thereby fix the panel to the housing frame.

As described above, the embodiment suppresses not only abnormal discharge in the intermediate area on the electron source substrate side along the acceleration potential supply path, but also abnormal discharge near at the acceleration electrode.

In RP 1, the independent wire 105 is connected to the earth lines of the X- and Y-direction FPC's 401-X and 401-Y connected to the earth patterns of the X- and Y-direction driver circuits. The lead-in portion of the independent wire 105 is exposed to the outside of the vacuum container in RP1, and in FP 11 the FP independent wire lead-in portion 50*b* of the independent wire 50*a* is exposed to the outside of the vacuum container. Both lead-in portions of the independent wires are made in contact with the contact member 51 connected to the front frame 96 connected to the earth potential of the power source unit. It is therefore possible to reliably define the earth potential of the independent wires of FP 11 and RP 1.

The contact member 51 fixed to the vacuum container has resilience and the abut members. Therefore, the contact member 51 will not be dismounted while it always pushes the FP independent wire lead-in portion 50*b* and independent wire lead-in portion 108 of FP 11 and RP 1 and the inner wall of the front frame. Since electrical connection can be established without a wiring work such as soldering and without fixing means such as screws, electrical connection can be maintained even if there are a change in the environmental temperature and a secular change.

By introducing this earth connection structure, the vacuum container can be supported by various methods, such as squeezing it by the front and rear frames, and adhering RP 1 to the housing frame. The degree of design freedom can thus be increased.

The material of the contactor, contact plate and contact member of the third, fourth and sixth embodiments is preferably stainless steel and phosphor bronze subjected to a plating process (anticorrosion process). The material may be phosphor bronze, steel, steel subjected to a plating process (anticorrosion process).

The front frames 96 and 131 of the embodiments are preferably formed by extrusion. The material of the front frames 96 and 131 may be coated with a conductive layer containing copper, nickel, carbon or the like.

According to the invention, abnormal discharge can be suppressed. A predetermined potential, particularly the earth potential, can be supplied reliably, easily and with good reproductivity to the abnormal discharge suppressing structure.

What is claimed is:

1. An electron-emitting apparatus comprising:

electron-emitting devices;

driving wires connected to said electron-emitting devices;

an electron source substrate on which said electron-emitting devices and said driving wires are arranged;

an acceleration electrode mounted at a position facing said electron source substrate, said acceleration electrode being applied with an acceleration potential for accelerating electrons emitted from said electron-emitting devices;

a potential supply path for supplying the acceleration potential to said acceleration electrode, said potential supply path being introduced via an intermediate area on the side of said electron source substrate;

a first wire formed around the intermediate area; and a resistor film formed between said first wire and the intermediate area, said resistor film electrically connected with said potential supply path and said first wire.

2. An electron-emitting apparatus according to claim 1, wherein said first wire is formed separately from said driving wires.

3. An electron-emitting apparatus according to claim 1, wherein said first wire surrounds completely a periphery of the intermediate area.

4. An electron-emitting apparatus comprising:

electron-emitting devices;

driving wires connected to said electron-emitting devices;

an electron source substrate on which said electron-emitting devices and said driving wires are arranged;

an acceleration electrode mounted at a position facing said electron source substrate, said acceleration electrode being applied with an acceleration potential for accelerating electrons emitted from said electron-emitting devices;

a potential supply path for supplying the acceleration potential to said acceleration electrode, said potential supply path being introduced via an intermediate area on the side of said electron source substrate;

a first wire provided separately from said driving wires and formed on a surface between the intermediate area and said driving wires; and a resistor film formed on a surface between said first wire and the intermediate area, said resistor film electrically connected with said potential supply path and said first wire.

5. An electron-emitting apparatus according to claim 1, wherein said first wire is applied with a predetermined potential.

6. An electron-emitting apparatus according to claim 4, wherein said first wire is applied with a predetermined potential.

7. An electron-emitting apparatus according to claim 5, wherein said first wiring is formed separately from said driving wires, and a potential difference between the predetermined potential and the acceleration potential is larger than a potential difference between the predetermined potential and a potential applied to said driving wires.

8. An electron-emitting apparatus according to claim 6, wherein said first wiring is formed separately from said driving wires, and a potential difference between the predetermined potential and the acceleration potential is larger than a potential difference between the predetermined potential and a potential applied to said driving wires.

9. An electron-emitting apparatus according to claim 5, wherein said first wiring is formed separately from said driving wires, and the predetermined potential is approximately a potential applied to said driving wires.

10. An electron-emitting apparatus according to claim 6, wherein said first wiring is formed separately from said driving wires, and the predetermined potential is approximately a potential applied to said driving wires.

11. An electron-emitting apparatus according to claim 1, wherein said first wire is a ring shape wire.

12. An electron-emitting apparatus according to claim 4, wherein said first wire is a ring shape wire.

13. An electron-emitting apparatus according to claim 1, wherein said first wire is formed so that each portion of said first wire is at an equal distance from each portion of the intermediate area most nearest to each portion of said first wire.

14. An electron-emitting apparatus according to claim 2, wherein said first wire is formed so that each portion of said first wire is at an equal distance from each portion of the intermediate area most nearest to each portion of said first wire.

15. An electron-emitting apparatus according to claim 1, wherein said first wire is connected to an earth.

16. An electron-emitting apparatus according to claim 2, wherein said first wire is connected to an earth.

17. An electron-emitting apparatus according to claim 1, wherein said resistor film has a sheet resistance of $1\times10^9$ Ω/□ or higher.

18. An electron-emitting apparatus according to claim 4, wherein said resistor film has a sheet resistance of $1\times10^9$ Ω/□ or higher.

19. An electron-emitting apparatus according to claim 1, wherein said resistor film has a sheet resistance of $1\times10^{16}$ Ω/□ or lower.

20. An electron-emitting apparatus according to claim 4, wherein said resistor film has a sheet resistance of 1×10 Ω/□ or lower.

21. An electron-emitting apparatus according to claim 1, wherein said resistor film has a resistance value not allowing abnormal discharge to be generated between the intermediate area and said first wire.

22. An electron-emitting apparatus according to claim 4, wherein said resistor film has a resistance value not allowing abnormal discharge to be generated between the intermediate area and said first wire.

23. An electron-emitting apparatus according to claim 1, wherein said resistor film is a nitride film of alloy of germanium and transition metal.

24. An electron-emitting apparatus according to claim 4, wherein said resistor film is a nitride film of alloy of germanium and transition metal.

25. An electron-emitting apparatus according to claim 23, wherein the transition metal is at least one metal selected from a group consisting of chromium, titanium, tantalum, molybdenum and tungsten.

26. An electron-emitting apparatus according to claim 24, wherein the transition metal is at least one metal selected from a group consisting of chromium, titanium, tantalum, molybdenum and tungsten.

27. An electron-emitting apparatus according to claim 1, wherein said resistor film has a specific resistance of $10^{-5}\times Va^2$ Ωcm or higher where Va is a potential difference between a potential applied to said first wire and the acceleration potential.

28. An electron-emitting apparatus according to claim 4, wherein said resistor film has a specific resistance of $10^{-5}\times Va^2$ Ωcm or higher where Va is a potential difference between a potential applied to said first wire and the acceleration potential.

29. An electron-emitting apparatus according to claim 1, wherein said resistor film has a specific resistance of $10^7$ Ωcm or lower.

30. An electron-emitting apparatus according to claim 4, wherein said resistor film has a specific resistance of $10^7$ Ωcm or lower.

31. An electron-emitting apparatus according to claim 1, wherein said resistor film has a thickness of 10 nm or thicker.

32. An electron-emitting apparatus according to claim 4, wherein said resistor film has a thickness of 10 nm or thicker.

33. An electron-emitting apparatus according to claim 1, wherein said resistor film has a thickness of 1 μm or thinner.

34. An electron-emitting apparatus according to claim 4, wherein said resistor film has a thickness of 1 μm or thinner.

35. An electron-emitting apparatus according to claim 1, wherein said resistor film has a resistance temperature coefficient of −1%/° C. or higher.

36. An electron-emitting apparatus according to claim 4, wherein said resistor film has a resistance temperature coefficient of −1%/° C. or higher.

37. An electron-emitting apparatus according to claim 1, wherein said resistor film has a negative resistance temperature coefficient.

38. An electron-emitting apparatus according to claim 4, wherein said resistor film has a negative resistance temperature coefficient.

39. An electron-emitting apparatus comprising:

electron-emitting devices;

driving wires connected to said electron-emitting devices;

an electron source substrate on which said electron-emitting devices and said driving wires are arranged;

an acceleration electrode mounted at a position facing said electron source substrate, said acceleration electrode being applied with an acceleration potential for accelerating electrons emitted from said electron-emitting devices;

a potential supply path for supplying the acceleration potential to said acceleration electrode, said potential supply path being introduced via an intermediate area on the side of said electron source substrate;

a first wire provided separately from said driving wires and formed on a surface between the intermediate area and said driving wires; and a periodical projection/recess structure formed on a surface between said first wire and the intermediate area.

40. An electron-emitting apparatus comprising:

electron-emitting devices;

driving wires connected to said electron-emitting devices;

an electron source substrate on which said electron-emitting devices and said driving wires are arranged;

an acceleration electrode mounted at a position facing said electron source substrate, said acceleration electrode being applied with an acceleration potential for accelerating electrons emitted from said electron-emitting devices;

a potential supply path for supplying the acceleration potential to said acceleration electrode, said potential supply path being introduced by passing through said electron source substrate;

a first wire provided separately from said driving wires and formed on a surface between a passing portion and said driving wires;

a sealing structure integrated with said potential supply path and hermetically mounted in a hole formed through said electron source substrate; and a projection/recess structure formed on a surface between said sealing structure and said first wire.

41. An electron-emitting apparatus according to claim 39, wherein said first wire is connected to an earth.

42. An electron-emitting apparatus according to claim 40, wherein said first wire is connected to an earth.

43. An electron-emitting apparatus according to claim 1, wherein said first wire has a lead portion extending to an outside of a vacuum container containing said electron-emitting devices, said acceleration electrode and said first wire, a conductive contact member is in contact with the lead portion, and a predetermined potential is applied to said first wire via the conductive contact member.

44. An electron-emitting apparatus according to claim 4, wherein said first wire has a lead portion extending to an outside of a vacuum container containing said electron-emitting devices, said acceleration electrode and said first wire, a conductive contact member is in contact with the lead portion, and a predetermined potential is applied to said first wire via the conductive contact member.

45. An electron-emitting apparatus according to claim 39, wherein said first wire has a lead portion extending to an outside of a vacuum container containing said electron-emitting devices, said acceleration electrode and said first wire, a conductive contact member is in contact with the lead portion, and a predetermined potential is applied to said first wire via the conductive contact member.

46. An electron-emitting apparatus according to claim 40, wherein said first wire has a lead portion extending to an outside of a vacuum container containing said electron-emitting devices, said acceleration electrode and said first wire, a conductive contact member is in contact with the lead portion, and a predetermined potential is applied to said first wire via the conductive contact member.

47. An electron-emitting apparatus according to claim 43, wherein the conductive contact member has an elastic portion and elasticity of the elastic portion pushes the lead portion of said first wire.

48. An electron-emitting apparatus according to claim 44, wherein the conductive contact member has an elastic portion and elasticity of the elastic portion pushes the lead portion of said first wire.

49. An electron-emitting apparatus according to claim 45, wherein the conductive contact member has an elastic portion and elasticity of the elastic portion pushes the lead portion of said first wire.

50. An electron-emitting apparatus according to claim 46, wherein the conductive contact member has an elastic portion and elasticity of the elastic portion pushes the lead portion of said first wire.

51. An electron-emitting apparatus according to claim 43, wherein the conductive contact member squeezes the lead portion of said first wire on said electron source substrate as well as said electron source substrate.

52. An electron-emitting apparatus according to claim 44, wherein the conductive contact member squeezes the lead portion of said first wire on said electron source substrate as well as said electron source substrate.

53. An electron-emitting apparatus according to claim 45, wherein the conductive contact member squeezes the lead portion of said first wire on said electron source substrate as well as said electron source substrate.

54. An electron-emitting apparatus according to claim 46, wherein the conductive contact member squeezes the lead portion of said first wire on said electron source substrate as well as said electron source substrate.

55. An electron-emitting apparatus according to claim 51, wherein the conductive contact member includes opposing portions, a distance between the opposing portions is longer than a thickness of said electron source substrate and a distance between opposing portions in contact with the lead portion of said first wire is shorter than the thickness of said electron source substrate, when the conductive contact member does not squeeze said electron source substrate.

56. An electron-emitting apparatus according to claim 52, wherein the conductive contact member includes opposing portions, a distance between the opposing portions is longer than a thickness of said electron source substrate and a distance between opposing portions in contact with the lead portion of said first wire is shorter than the thickness of said electron source substrate, when the conductive contact member does not squeeze said electron source substrate.

57. An electron-emitting apparatus according to claim 53, wherein the conductive contact member includes opposing portions, a distance between the opposing portions is longer than a thickness of said electron source substrate and a distance between opposing portions in contact with the lead portion of said first wire is shorter than the thickness of said electron source substrate, when the conductive contact member does not squeeze said electron source substrate.

58. An electron-emitting apparatus according to claim 54, wherein the conductive contact member includes opposing portions, a distance between the opposing portions is longer than a thickness of said electron source substrate and a distance between opposing portions in contact with the lead portion of said first wire is shorter than the thickness of said electron source substrate, when the conductive contact member does not squeeze said electron source substrate.

59. An electron-emitting apparatus according to claim 51, further comprising a second wire different from said acceleration electrode disposed on an acceleration electrode substrate on which said acceleration electrode is formed, wherein said conductive contact member is electrically connected to both lead portions of said first and second wires.

60. An electron-emitting apparatus according to claim 44, further comprising a second wire different from said acceleration electrode disposed on an acceleration electrode substrate on which said acceleration electrode is formed, wherein said conductive contact member is electrically connected to both lead portions of said first and second wires.

61. An electron-emitting apparatus according to claim 45, further comprising a second wire different from said acceleration electrode disposed on an acceleration electrode substrate on which said acceleration electrode is formed, wherein said conductive contact member is electrically connected to both lead portions of said first and second wires.

62. An electron-emitting apparatus according to claim 46, further comprising a second wire different from said acceleration electrode disposed on an acceleration electrode substrate on which said acceleration electrode is formed, wherein said conductive contact member is electrically connected to both lead portions of said first and second wires.

63. An electron-emitting apparatus according to claim 59, wherein at least a portion of the conductive contact member is squeezed between said electron source substrate and the acceleration electrode substrate, and the conductive contact member is in contact with both lead portions of said first and second wires on said electron source substrate and on the acceleration electrode substrate.

64. An electron-emitting apparatus according to claim 60, wherein at least a portion of the conductive contact member is squeezed between said electron source substrate and the acceleration electrode substrate, and the conductive contact member is in contact with both lead portions of said first and second wires on said electron source substrate and on the acceleration electrode substrate.

65. An electron-emitting apparatus according to claim 61, wherein at least a portion of the conductive contact member is squeezed between said electron source substrate and the acceleration electrode substrate, and the conductive contact member is in contact with both lead portions of said first and second wires on said electron source substrate and on the acceleration electrode substrate.

66. An electron-emitting apparatus according to claim 62, wherein at least a portion of the conductive contact member is squeezed between said electron source substrate and the acceleration electrode substrate, and the conductive contact member is in contact with both lead portions of said first and second wires on said electron source substrate and on the acceleration electrode substrate.

67. An electron-emitting apparatus according to claim 43, wherein the conductive contact member has a portion with conductivity and pressure sensitive adhesion, the portion with the pressure sensitive adhesion being in contact with the lead portion of said first wire.

68. An electron-emitting apparatus according to claim 44, wherein the conductive contact member has a portion with conductivity and pressure sensitive adhesion, the portion with the pressure sensitive adhesion being in contact with the lead portion of said first wire.

69. An electron-emitting apparatus according to claim 45, wherein the conductive contact member has a portion with conductivity and pressure sensitive adhesion, the portion with the pressure sensitive adhesion being in contact with the lead portion of said first wire.

70. An electron-emitting apparatus according to claim 46, wherein the conductive contact member has a portion with conductivity and pressure sensitive adhesion, the portion with the pressure sensitive adhesion being in contact with the lead portion of said first wire.

71. An electron-emitting apparatus according to claim 67, wherein another member as a path for applying a predetermined potential to said first wire is in contact with another portion with the pressure sensitive adhesion of the conductive contact member.

72. An electron-emitting apparatus according to claim 68, wherein another member as a path for applying a predetermined potential to said first wire is in contact with another portion with the pressure sensitive adhesion of the conductive contact member.

73. An electron-emitting apparatus according to claim 69, wherein another member as a path for applying a predetermined potential to said first wire is in contact with another portion with the pressure sensitive adhesion of the conductive contact member.

74. An electron-emitting apparatus according to claim 70, wherein another member as a path for applying a predetermined potential to said first wire is in contact with another portion with the pressure sensitive adhesion of the conductive contact member.

75. An electron-emitting apparatus according to claim 43, wherein the conductive contact member contacts a lead portion extended on a surface which is the same as the surface on which said first wire is formed.

76. An electron-emitting apparatus according to claim 44, wherein the conductive contact member contacts a lead portion extended on a surface which is the same as the surface on which said first wire is formed.

77. An electron-emitting apparatus according to claim 45, wherein the conductive contact member contacts a lead portion extended on a surface which is the same as the surface on which said first wire is formed.

78. An electron-emitting apparatus according to claim 46, wherein the conductive contact member contacts a lead portion extended on a surface which is the same as the surface on which said first wire is formed.

79. An electron-emitting apparatus according to claim 43, further comprising a conductive cover covering at least a portion of the vacuum container wherein the conductive contact member is electrically connected to said cover.

80. An electron-emitting apparatus according to claim 44, further comprising a conductive cover covering at least a portion of the vacuum container wherein the conductive contact member is electrically connected to said cover.

81. An electron-emitting apparatus according to claim 45, further comprising a conductive cover covering at least a portion of the vacuum container wherein the conductive contact member is electrically connected to said cover.

82. An electron-emitting apparatus according to claim 46, further comprising a conductive cover covering at least a portion of the vacuum container wherein the conductive contact member is electrically connected to said cover.

83. An electron-emitting apparatus according to claim 79, wherein the conductive contact member is fixed to said cover.

84. An electron-emitting apparatus according to claim 80, wherein the conductive contact member is fixed to said cover.

85. An electron-emitting apparatus according to claim 81, wherein the conductive contact member is fixed to said cover.

86. An electron-emitting apparatus according to claim 82, wherein the conductive contact member is fixed to said cover.

87. An electron-emitting apparatus according to claim 43, wherein the conductive contact member is connected to an electrical cable, and a predetermined potential is applied to the conductive contact member via the electrical cable.

88. An electron-emitting apparatus according to claim 44, wherein the conductive contact member is connected to an electrical cable, and a predetermined potential is applied to the conductive contact member via the electrical cable.

89. An electron-emitting apparatus according to claim 45, wherein the conductive contact member is connected to an electrical cable, and a predetermined potential is applied to the conductive contact member via the electrical cable.

90. An electron-emitting apparatus according to claim 46, wherein the conductive contact member is connected to an electrical cable, and a predetermined potential is applied to the conductive contact member via the electrical cable.

91. An electron-emitting apparatus according to claim 1, wherein the lead portion of said first wire and the lead portions of said driving wires are connected to a common flexible printed circuit.

92. An electron-emitting apparatus according to claim 4, wherein the lead portion of said first wire and the lead portions of said driving wires are connected to a common flexible printed circuit.

93. An electron-emitting apparatus according to claim 39, wherein the lead portion of said first wire and the lead portions of said driving wires are connected to a common flexible printed circuit.

94. An electron-emitting apparatus according to claim 40, wherein the lead portion of said first wire and the lead portions of said driving wires are connected to a common flexible printed circuit.

95. An electron-emitting apparatus according to claim 1, wherein an acceleration electrode substrate on which said acceleration electrode is formed constitutes a portion of a vacuum container, and the acceleration electrode has a conductive layer formed outside of the vacuum container.

96. An electron-emitting apparatus according to claim 4, wherein an acceleration electrode substrate on which said acceleration electrode is formed constitutes a portion of a vacuum container, and the acceleration electrode has a conductive layer formed outside of the vacuum container.

97. An electron-emitting apparatus according to claim 39, wherein an acceleration electrode substrate on which said acceleration electrode is formed constitutes a portion of a vacuum container, and the acceleration electrode has a conductive layer formed outside of the vacuum container.

98. An electron-emitting apparatus according to claim 40, wherein an acceleration electrode substrate on which said acceleration electrode is formed constitutes a portion of a vacuum container, and the acceleration electrode has a conductive layer formed outside of the vacuum container.

99. An electron-emitting apparatus according to claim 95, wherein said first wire is applied with a predetermined potential via the conductive layer.

100. An electron-emitting apparatus according to claim 96, wherein said first wire is applied with a predetermined potential via the conductive layer.

101. An electron-emitting apparatus according to claim 97, wherein said first wire is applied with a predetermined potential via the conductive layer.

102. An electron-emitting apparatus according to claim 98, wherein said first wire is applied with a predetermined potential via the conductive layer.

103. An electron-emitting apparatus according to claim 95, wherein the conductive layer is electrically connected to a conductive cover covering at least a portion of a vacuum container constituted of the acceleration electrode substrate.

104. An electron-emitting apparatus according to claim 96, wherein the conductive layer is electrically connected to a conductive cover covering at least a portion of a vacuum container constituted of the acceleration electrode substrate.

105. An electron-emitting apparatus according to claim 97, wherein the conductive layer is electrically connected to a conductive cover covering at least a portion of a vacuum container constituted of the acceleration electrode substrate.

106. An electron-emitting apparatus according to claim 98, wherein the conductive layer is electrically connected to a conductive cover covering at least a portion of a vacuum container constituted of the acceleration electrode substrate.

107. An electron-emitting apparatus according to claim 103, wherein an electrical connection between the conductive layer and the conductive cover is established by a member having elasticity and conductivity.

108. An electron-emitting apparatus according to claim 104, wherein an electrical connection between the conductive layer and the conductive cover is established by a member having elasticity and conductivity.

109. An electron-emitting apparatus according to claim 105, wherein an electrical connection between the conductive layer and the conductive cover is established by a member having elasticity and conductivity.

110. An electron-emitting apparatus according to claim 106, wherein an electrical connection between the conductive layer and the conductive cover is established by a member having elasticity and conductivity.

111. An electron-emitting apparatus comprising:

electron-emitting devices;

driving wires connected to said electron-emitting devices;

an electron source substrate on which said electron-emitting devices and said driving wires are arranged;

an acceleration electrode substrate facing said electron source substrate;

an acceleration electrode mounted on said acceleration electrode substrate and being applied with an acceleration potential for accelerating electrons emitted from said electron-emitting devices;

a potential supply path for supplying the acceleration potential to said acceleration electrode, said potential supply path being introduced via an intermediate area on the side of said electron source substrate;

a first wire provided separately from said driving wires and formed on a surface between the intermediate area and said driving wires; and a second wire provided separately from said acceleration electrode around said acceleration electrode on said acceleration electrode substrate, wherein a space surrounded by said electron source substrate, said acceleration electrode substrate and a peripheral frame is maintained as a vacuum atmosphere, a lead portion of said first wire is extended outside of the vacuum atmosphere, a lead portion of said second wire is extended outside of the vacuum atmosphere, and a conductive contact member is in contact with the lead portions of said first and second wires.

112. An electron-emitting apparatus according to claim 111, wherein the conductive contact member is in contact with both lead portions of said first and second wires to apply a predetermined common potential to both lead portions.

113. An electron-emitting apparatus according to claim 111, wherein the lead portion of said first wire in contact with the conductive contact member is formed on said electron source substrate, and the lead portion of said second wire in contact with the conductive contact member is formed on said acceleration electrode substrate.

114. An electron-emitting apparatus according to claim 111, wherein the conductive contact member has an elastic portion which functions to push the lead portions of said first and second wires.

115. An electron-emitting apparatus according to claim 1, wherein the acceleration potential is higher by 3 kV or more than the lowest potential to be applied to said driving wires to drive said electron-emitting devices.

116. An electron-emitting apparatus according to claim 4, wherein the acceleration potential is higher by 3 kV or more than the lowest potential to be applied to said driving wires to drive said electron-emitting devices.

117. An electron-emitting apparatus according to claim 39, wherein the acceleration potential is higher by 3 kV or more than the lowest potential to be applied to said driving wires to drive said electron-emitting devices.

118. An electron-emitting apparatus according to claim 40, wherein the acceleration potential is higher by 3 kV or more than the lowest potential to be applied to said driving wires to drive said electron-emitting devices.

119. An electron-emitting apparatus according to claim 111, wherein the acceleration potential is higher by 3 kV or more than the lowest potential to be applied to said driving wires to drive said electron-emitting devices.

120. An electron-emitting apparatus according to claim 1, further comprising a phosphor which emits light upon incidence of electrons accelerated by the acceleration potential.

121. An electron-emitting apparatus according to claim 4, further comprising a phosphor which emits light upon incidence of electrons accelerated by the acceleration potential.

122. An electron-emitting apparatus according to claim 39, further comprising a phosphor which emits light upon incidence of electrons accelerated by the acceleration potential.

123. An electron-emitting apparatus according to claim 42, further comprising a phosphor which emits light upon incidence of electrons accelerated by the acceleration potential.

124. An electron-emitting apparatus according to claim 111, further comprising a phosphor which emits light upon incidence of electrons accelerated by the acceleration potential.

125. An image-forming apparatus comprising an electron-emitting apparatus recited in claim 1 and a phosphor which emits light upon incidence of electrons accelerated by the acceleration potential.

126. An image-forming apparatus comprising an electron-emitting apparatus recited in claim 4 and a phosphor which emits light upon incidence of electrons accelerated by the acceleration potential.

127. An image-forming apparatus comprising an electron-emitting apparatus recited in claim 39 and a phosphor which emits light upon incidence of electrons accelerated by the acceleration potential.

128. An image-forming apparatus comprising an electron-emitting apparatus recited in claim 40 and a phosphor which emits light upon incidence of electrons accelerated by the acceleration potential.

129. An image-forming apparatus comprising an electron-emitting apparatus recited in claim 111 and a phosphor which emits light upon incidence of electrons accelerated by the acceleration potential.

130. An electron-emitting apparatus comprising:

electron-emitting devices;

driving wires connected to said electron-emitting devices;

an electron source substrate on which said electron-emitting devices and said driving wires are arranged;

an acceleration electrode mounted at a position facing said electron source substrate, said acceleration electrode being applied with an acceleration potential for accelerating electrons emitted from said electron-emitting devices;

a potential supply path for supplying the acceleration potential to said acceleration electrode, at least a portion of said potential supply path passing through said electron source substrate;

a first wire provided separately from said driving wires and formed on a surface between the portion of said potential supply path and said driving wires; and a resistor film formed on a surface between said first wire and the portion of said potential supply path, said resistor film being electrically connected with said potential supply path and said first wire.

131. An electron-emitting apparatus comprising:

electron-emitting devices;

driving wires connected to said electron-emitting devices;

an electron source substrate on which said electron-emitting devices and said driving wires are arranged;

an acceleration electrode mounted at a position facing said electron source substrate, said acceleration electrode being applied with an acceleration potential for accelerating electrons emitted from said electron-emitting devices;

a potential supply path for supplying an acceleration potential to said acceleration electrode, at least a portion of said potential supply path passing through said electron source substrate;

a first wire provided separately from said driving wires and formed on a surface between the portion of said potential supply path and said driving wires; and a periodical projection/recess structure formed on a surface between said first wire and the portion of said potential supply path.

132. An electron-emitting apparatus comprising:

electron-emitting devices;

driving wires connected to said electron-emitting devices;

an electron source substrate on which said electron-emitting devices and said driving wires are arranged;

an acceleration electrode mounted at a position facing said electron source substrate, said acceleration electrode being applied with an acceleration potential for accelerating electrons emitted from said electron-emitting devices;

a potential supply path for supplying the acceleration potential to said acceleration electrode, at least a portion of said potential supply path passing through said electron source substrate;

a first wire provided separately from said driving wires and formed on a surface between the portion of said potential supply path and said driving wires;

a sealing structure integrated with said potential supply path and hermetically mounted in a hole formed through said electron source substrate; and a periodical projection/recess structure formed on a surface between said sealing structure and said first wire.

133. An electron-emitting apparatus comprising:

electron-emitting devices;

driving wires connected to said electron-emitting devices;

an electron source substrate on which said electron-emitting devices and said driving wires are arranged;

an acceleration electrode substrate facing said electron source substrate;

an acceleration electrode mounted on said acceleration electrode substrate and being applied with an acceleration potential for accelerating electrons emitted from said electron-emitting devices;

a potential supply path for supplying the acceleration potential to said acceleration electrode, said potential supply path being introduced via an intermediate area on a side of said electron source substrate;

a first wire provided separately from said driving wires and formed on a surface between the intermediate area and said driving wires; and a second wire provided separately from said acceleration electrode around said acceleration electrode on said acceleration electrode substrate, wherein a space surrounded by said electron source substrate, said acceleration electrode substrate and a peripheral frame is maintained as having a vacuum atmosphere, a lead portion of said first wire is extended outside of the vacuum atmosphere, a lead portion of said second wire is extended outside of the vacuum atmosphere, and a conductive contact member is in contact with the lead portions of said first and second wires.

134. An electron-emitting apparatus comprising:

electron-emitting devices;

driving wires connected to said electron-emitting devices;

an electron source substrate on which said electron-emitting devices and said driving wires are arranged, wherein on said substrate is provided a portion to which an acceleration potential for accelerating electrons emitted from said electron-emitting devices is supplied;

a first wire provided separately from said driving wires and formed on a surface between the portion and said driving wires; and a periodical projection/recess structure formed on a surface between said first wire and the portion.

135. An electron-emitting apparatus comprising:

electron-emitting devices;

driving wires connected to said electron-emitting devices;

an electron source substrate on which said electron-emitting devices and said driving wires are arranged, wherein on said substrate is provided a portion to which an acceleration potential for accelerating electrons emitted from said electron-emitting devices is supplied;

an electroconductive film provided separately from said driving wires and formed on a surface between the portion and said driving wires; and a periodical projection/recess structure formed on a surface between a first wire and the portion.

* * * * *

UNITED STATES PATENT AND TRADEMARK OFFICE

CERTIFICATE OF CORRECTION

PATENT NO. : 6,885,156 B2
DATED : April 26, 2005
INVENTOR(S) : Hisao Tajima et al.

It is certified that error appears in the above-identified patent and that said Letters Patent is hereby corrected as shown below:

Column 29,
Line 48, "$1 \times 10\Omega/\square$" should read -- $1 \times 10^{16}\Omega/\square$ --.

Signed and Sealed this

Sixth Day of September, 2005

JON W. DUDAS
*Director of the United States Patent and Trademark Office*